US008079398B2

(12) United States Patent
Tsukamoto

(10) Patent No.: US 8,079,398 B2
(45) Date of Patent: Dec. 20, 2011

(54) BLIND

(76) Inventor: Tatusabu Tsukamoto, Kanzaki (JP)

( * ) Notice: Subject to any disclaimer, the term of this patent is extended or adjusted under 35 U.S.C. 154(b) by 846 days.

(21) Appl. No.: 11/661,692

(22) PCT Filed: Sep. 6, 2004

(86) PCT No.: PCT/JP2004/013275

§ 371 (c)(1),
(2), (4) Date: Oct. 9, 2007

(87) PCT Pub. No.: WO2005/024168

PCT Pub. Date: Mar. 17, 2005

(65) Prior Publication Data

US 2011/0067823 A1 Mar. 24, 2011

(51) Int. Cl.
*E06B 9/32* (2006.01)

(52) U.S. Cl. ..... 160/115; 160/84.03; 160/170

(58) Field of Classification Search ..... 160/115, 160/84.03, 168.1 R, 176.1 R, 170, 167 R
See application file for complete search history.

(56) References Cited

U.S. PATENT DOCUMENTS 1,756,680 A 9/1930 Dodge
2,276,425 A * 3/1942 Slattery ..... 160/19
2,979,127 A * 4/1961 Brown ..... 160/115
5,791,390 A * 8/1998 Watanabe ..... 160/84.03
6,196,292 B1 * 3/2001 Jackson ..... 160/113
6,202,731 B1 * 3/2001 Rulon ..... 160/178.1 R
6,227,279 B1 * 5/2001 Belongia et al. ..... 160/115

FOREIGN PATENT DOCUMENTS

JP 2002-89154 A 3/2002

OTHER PUBLICATIONS

International Search Report of PCT/JP2004/013275, date of mailing Jan. 25, 2005.

* cited by examiner

*Primary Examiner* — David Purol
(74) *Attorney, Agent, or Firm* — Westerman, Hattori, Daniels & Adrian, LLP

(57) ABSTRACT

A blind is provided which uses a toothed band bodies such as slender toothed belts as rod holding bodies including operating band bodies, instead of conventional cords and tape, having a straightforward structure providing accurate and stable parallel holding of moving rods, and quit and smooth movement, due to accurate operations without slippage due to engaging of bands and wheels having teeth, without problems such as tangling and bending and the like. Particularly, a rod movement holding device suitable for having multiple moving rods and having multiple shielding adjustment faces, and a blind having a rod operating device, can be provided.

19 Claims, 18 Drawing Sheets

BLIND

TECHNICAL FIELD

The present invention relates to a device for movement, holding, and operating of rods related to an upper rod and lower rod which move relatively and a rod holding body which connects the two rods, in so-called Venetian blinds.

BACKGROUND ART

Conventionally, round ropes or cords are commonplace for rod holding bodies in such blinds, with metal tape or the like being used in some. Nowadays, while there is demand for free shielding patterns of the multiple shielding adjustment faces with a single device, conventional rod holding bodies and toothed rod band holding devices thereof are shortcomings in meeting such demands.

For example, moving and holding the lower moving rod by raising/lowering ropes or tapes hanging down through the blade faces with a conventional movement holding device within the upper rod has problems such as there being no resistance in the slack direction of the rope or the like and so trouble due to slack readily occurs.

It is an object of the present invention to provide a blind capable of precise and stable parallel holding of the moving rod and quiet and smooth raising/lowering operations.

It is another object of the present invention to provide a blind having a rod moving-and-holding device with a simple structure, which does not readily encounter trouble or the like due to slack of rod holding bodies, and is robust and has excellent durability.

It is yet another object of the present invention to provide a blind having a rod movement holding device which performs parallel movement and holding of the moving rod due to exact and precise winding.

It is yet another object of the present invention to provide a blind having multiple shielding adjustment faces of a rod moving-and-holding device, suitable for moving multiple moving rods.

It is yet another object of the present invention to provide a blind having a rod operating device whereby rod moving operations and holding operations are performed in an easy and sure manner.

It is yet another object of the present invention to provide a blind having a rod operating device whereby fine and sure rod moving operations can be performed.

It is yet another object of the present invention to provide a blind wherein moving operations and the like of all moving rods can be easily performed either manually or by electric motor as necessary.

DISCLOSURE OF INVENTION

The present invention is a horizontal shielding blade blind including at least a pair of rod holding bodies formed of toothed rod bands disposed between the upper rod and moving rod; a toothed rod band holding device for holding the end on one side of the toothed rod band at the side of at least one rod of the upper rod and the moving rod; and rod operating means which holds the other end of the toothed rod band at the other rod, and relative movement and holding between the upper rod and the lower rod is performed by way of the toothed rod band by the rod operating means at the one rod side.

Also, the toothed rod band holding device may further include a horizontal tube body which is borne by an axial movement rotating bearing within a rod so as to be movable in the axial direction, and to a part of which is rotationally linked a rod operating device; with one end of the toothed band body being held by winding in spiral fashion in the same direction on the tube body, and relative movement and holding between the upper rod and the lower rod being performed by way of rotational operations of the rod operating device.

Also, according to another embodiment, the toothed rod band holding device may further comprise a horizontal shaft rotationally borne by a bearing within a rod and rotationally linked to a rod operating device, and respective tube bodies which are rotationally linked and held so as to move in the axial direction and to simultaneously rotate with the horizontal shaft at a position facing respective toothed rod bands on the horizontal shaft.

Also, the toothed rod band holding device may further fixedly comprise, on an inner position of the movement range of the tube body, and at the side of either the tube body and rod, a lead screw groove parallel to the tube body and in the same twisting direction matching the winding pitch of the toothed rod band, however small, and also comprise a tube lead screw device fixedly having a tube lead body having a protrusion preferably in a screw form, matching and engaging with the lead screw groove, on the engaging side.

Also, according to another embodiment, the toothed rod band holding device may further fixedly comprise side guiding faces for guiding the side face of the toothed rod band, to the winding portion of the toothed band to the tube body at the rod side, and back guide faces for guiding the back face of the toothed rod band.

Also, the toothed rod band holding device may further fixedly comprise a pair of gears on a horizontal shaft rotationally borne within the upper rod by a bearing, and comprise a pair of toothed rod bands which are wound meshing with the gears with the back side of the winding portion joining corresponding positions on the moving rod and with the front side thereof hanging down at the front side of the horizontal shielding blade, and include a rod operating device having stopping piece means formed of a stopping piece having a toothed face capable of meshing with an operating side gear facing the toothed face on at least the upper side thereof, the stopping piece being guided by stopping piece guide means generally vertically toward the operating side gear and the front side hanging-down portion of an operating-side toothed rod band with at least one of the pair of toothed rod bands serving as the operating-side toothed rod band, the stopping piece being disposed below the operating side gear on which the operating-side toothed rod band is wound.

Now, the rod stopping means may include a stopping piece having a toothed face capable of meshing with the front side hanging-down portion facing the front side thereof, the stopping piece being guided by stopping piece guide means generally obliquely vertically toward the operating side gear and the front side hanging-down portion of the operating-side toothed band, the stopping piece being disposed below the operating side gear on which the operating-side toothed band is wound; and a back guide face fixedly provided at the rod side of the front side hanging down portion at the back face side; with rod-stopping being performed by pinching the front side hanging-down portion between the toothed face and the back guide face.

Further, the toothed rod band holding device may further include: a horizontal shaft provided within a moving rod movably held on a pair of toothed rod bands hanging down from the upper rod, rotatably borne by a bearing within the moving rod, and rotationally linked at a part thereof to a rod operating device; and a pair of moving gears fixed at a position facing the pair of toothed rod bands of the horizontal shaft, meshing with the pair of toothed rod bands.

The rod operating device may further include a toothed operating band of which one end is wound in spiral fashion on the circumference of a tube body in a direction opposite to the toothed rod band, with the other end thereof hanging downwards from the front side of the tube body; and rod stopping means including a stopping piece having a toothed face meshing with the front side hanging down portion, of the toothed operating band, facing the front side thereof, the stopping piece being guided by stopping piece guide means generally obliquely vertically toward the tube body and the front side hanging-down portion of the toothed operating band, the stopping piece being disposed below the tube body at the winding position of the toothed operating band; with the toothed operating band and the toothed rod band being alternately wound and unwound.

Also, the rod operating device may further include: an operating gear preferably rotatably borne within a rod by a bearing and rotationally linked to a rotating shaft of the toothed rod band holding device by a conveyance mechanism, and at least directly linked to the rotating shaft of the toothed rod band holding device rotatably borne by a bearing; a toothed operating band which meshes with the operating gear and is wound, with the front side thereof being the pulling side and the reverse side being the slack side; a stopping piece which moves fore and aft being guided by stopping piece guiding means between the pulling side and slack side below the operating gear, and having on the front side thereof a toothed face meshing with the pulling side and on the back side thereof a push-out portion; push-out means provided behind the stopping piece to guide the slack side, operating under operations of the slack side; a side guiding face fixed at the pull side at a back face position of the slack side; and inner side guide means between the pulling side and the slack side, disposed below the stopping piece; and comprise rod stopping means for rod-stopping by pinching the pulling side between the toothed face and the back guide faces.

Now, the operating gear may be designed so as to be directly attached to the rotating shaft of the toothed rod band holding device rotatably borne by the bearing so as to be directly rotatably linked to the rotating shaft.

Further, the push-out means may have a recessed face formed at the wide side below the operating gear for guiding the slack side of the toothed operating band in a slack manner at the time of the stopping piece retreating, and a toothed face for meshing with the puling side formed on the front face thereof, the toothed face moving fore and aft between the puling side and the recessed face side by being guided by the stopping piece guiding means; and the push-out means having a stopping piece having a push-out portion which guides the inner side of the slack side to the recessed face at the time of the meshing being disengaged at the back side thereof.

Also, the push-out means may have a push-out lever supported in a rocking manner on a lever pin horizontally fixed at the rod side behind the stopping piece, having a band guide face on the front side thereof, and a lever portion of a pushing portion extending behind the stopping piece on the upper side thereof; lever returning means including a retuning spring or back-side weight or the like provided to the push-out lever; and a stopping piece having an abutting portion for receiving the pushing portion of the push-out lever behind.

Further, the rod operating device may further include: an operating gear preferably rotatably borne within a rod by a bearing and rotationally linked to a rotating shaft of the toothed rod band holding device by a conveyance mechanism; a toothed operating band which meshes with the operating gear and is wound, with the front side of the winding being the pulling side and the reverse side being the slack side; a stopping piece which moves vertically being guided by stopping piece guiding means between the pulling side and slack side below the operating gear, and having on the upper side thereof a toothed face meshing with the lower portion of the operating gear and on the bottom side thereof a push-up face portion; a push-out lever supported in a rocking manner on a lever pin horizontally fixed at the rod side behind the stopping piece, having a band guide face on the front side thereof, and a lever portion having a pushing portion extending below the stopping piece on the upper side thereof; lever return means including a return spring or the like provided to the push-out lever; and inner side guide means between the pulling side and the slack side, disposed below the stopping piece; and comprising rod stopping means for rod-stopping by meshing of the toothed face with the operating gear.

Further, blind may be configured such that a rotating shaft rotatably supported by a gearing in a rod and rotatably having the toothed rod band holding device and rod operating device is provided, wherein an electric-powered operating motor is provided adjacent to an operating tube body of the rod operating device, and wherein an electromagnetic clutch is provided between the operating motor and the operating tube body whereby the operating motor side and the operating shaft are linked only in the event that power is supplied to an operating power source, switching to linking of the operating tube body and the rotating shaft when power is not applied, so as to be capable of manual/electric switching operations.

Now, toothed band (toothed rod band and toothed operating band) means a flat band-shaped body, such as a slender toothed belt having a constant and precise width and thickness, and having strong elasticity and flexibility. This has strong resilience, without deforming under compression or pulling. Also, while not restricted to this, notches such as teeth having a constant pitch are provided on the front side or rear side or both sides, as with a toothed belt. These notches provide bending flexibility proportionate to the thickness of the rod band, enabling to make a device which performs parallel movement and holding of the moving rod using gears with accurate and precise winding.

Further, the band bodies and wheels have tooth and operate meshing with the engaging stopping piece, thereby realizing a rod operating device wherein stopping operations are smooth and precise.

Other inventions will become clear in the preferred embodiments described below.

BEST MODE FOR CARRYING OUT THE INVENTION

Figure 1:
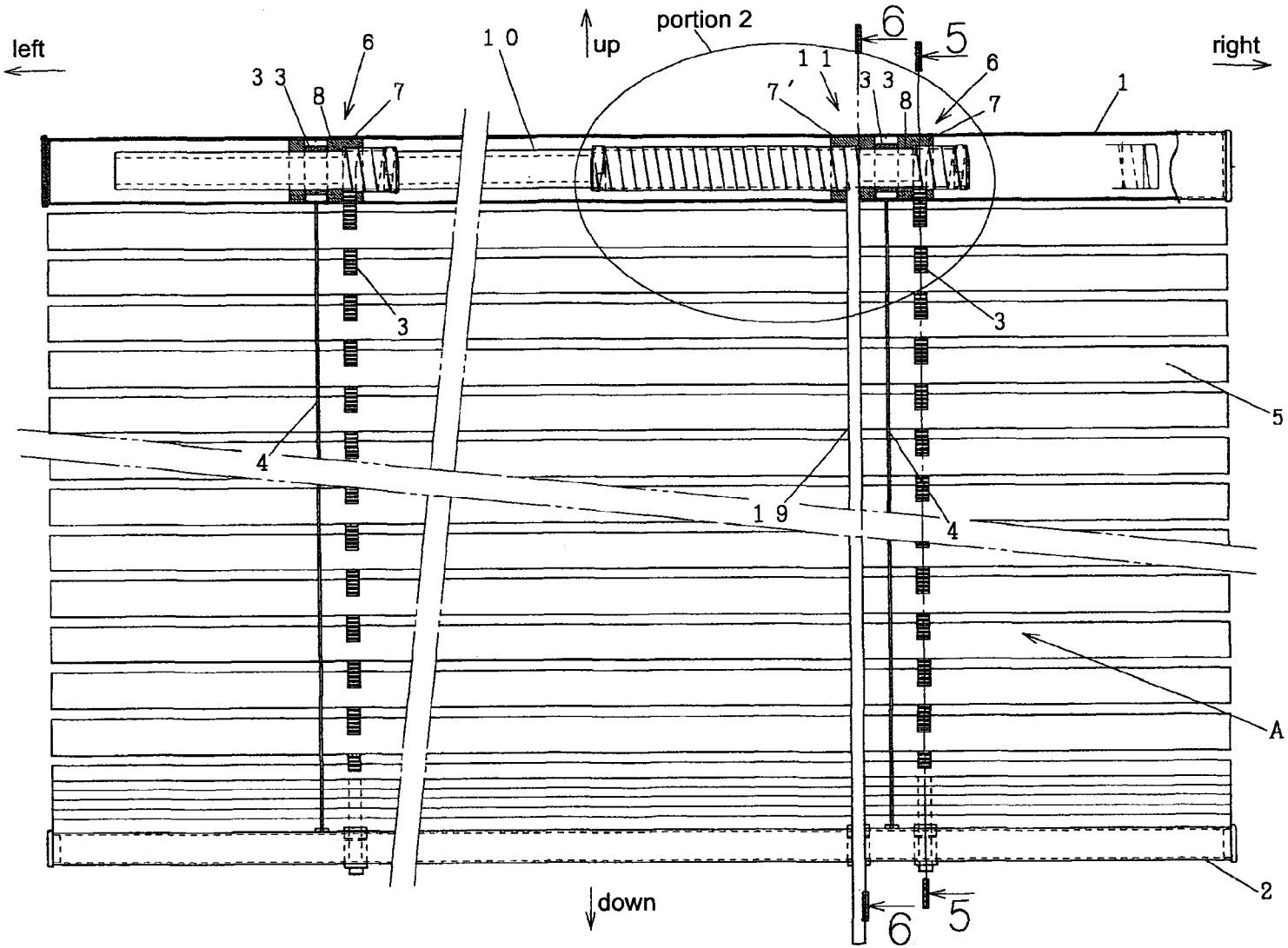
FIG. 1 is a diagram illustrating a frontal view of a blind according to an embodiment of the present invention partially cutaway.

Embodiments according to the present invention will be described, based on examples, with reference to the diagrams.

With the horizontal shielding blade blind illustrated in FIGS. 1 through 6, a moving rod 2 is held below an upper rod 1 fixed to the upper portion of a window, by two toothed rod bands 3 hanging down from the upper rod 1 with a desired spacing. A blade holding cord 4 hangs down from a holding ring of a blade operating device from the upper rod 1 to the moving rod 2, and a horizontal shielding blade 5 is held by this blade holding cord 4 to form a shield adjusting face A. The toothed rod bands 3 are disposed through a band holes of the horizontal shielding blade 5 to reach the moving rod. An axial movement rotating bearing 8 is provided on a case 7 fixed at a winding portion of each toothed band body in the upper rod 1, and one horizontal tube body 10 is supported in a manner capable of moving in the axial direction, as well as rotating, to two axial movement rotating bearing 8. The location of the axial movement rotating bearing is not particularly restricted, but here it is provided in the vicinity of the winding portion of the toothed rod band. The two toothed rod bands 3 passing through the band holes of the horizontal shielding blade 5 are toothed belts, having the toothed face thereof facing the front direction of the blind. The lower end sides thereof are each fixed to the moving rod 2, and the upper sides thereof are wound onto a location corresponding to each tube body 10. Now, each toothed rod band 3 hangs down to the moving rod 2 from the back side of the tube body whereupon the toothed rod band 3 is wound dextrorsely from the left side of the tube body 10 towards the right side, and holds the moving rod 2 horizontally. Rod operating means 11 such as will be described later are provided on the tube body 10, so by the tube body 10 rotating by the operation for the rod operating means 11, the toothed rod bands 3 can be wound spirally, or unwound, to move the moving rod 2 up and down. When the toothed rod bands 3 are being wound, the tube body 10 moves rightward, and when the toothed rod bands 3 are being unwound, the tube 10 moves leftward. Thus a toothed rod band holding device 6 is configured.

Figure 2:
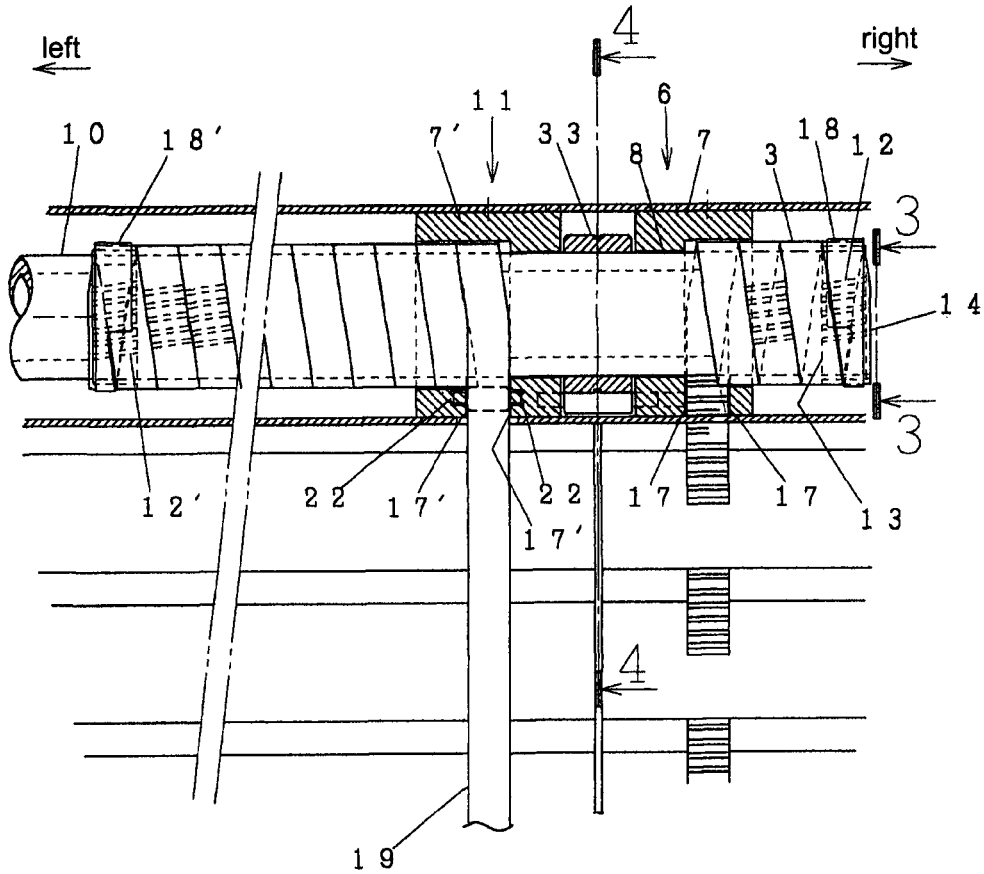
FIG. 2 is a diagram with portion 2 in FIG. 1 enlarged.
Figure 3:
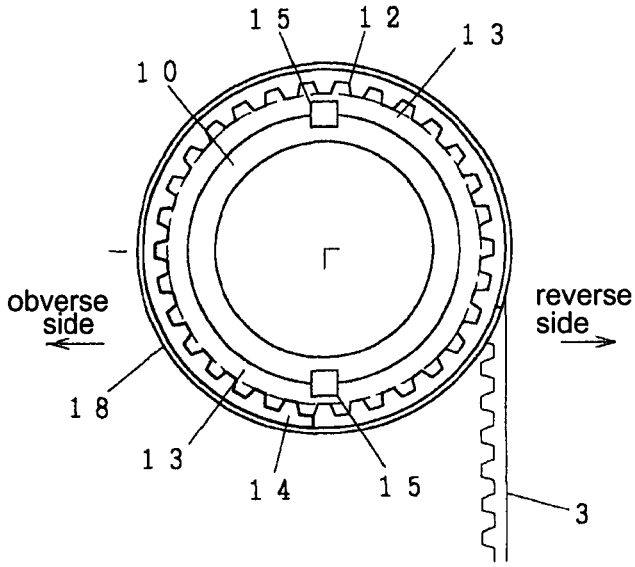
FIG. 3 is a view along arrow 3-3 in FIG. 2.

In FIGS. 2 and 3, helical teeth 12 are formed at a slanted angle matching the winding notch angle of the toothed rod band 3, with notches thereof matching the notches of the toothed rod band 3, on the outer circumference on the front side (right side) of the rod band winding of the tube body 10. Now, a band fixing ring 13 is fixedly fit into a recessed portion formed on the end face portion of the tube body 10, so as to embrace two turn-stopping keys 15 from the outer side which are buried in the recessed portion. The band fixing ring 13 is a gear having helical teeth similar to that described above on the outer circumference thereof, and the tooth portions thereof protrude from circumference of the tube body 10 only the amount of height of an approximate tooth height. Thus, the tip portion 14 of the toothed rod band 3 is engaged with the tooth portions on the outer circumference of the band fixing ring 13 and smoothly wound onto the outer circumference of the back side (left side) of the winding. A fixing ring 13 arranged to firmly fix the tip portion 14 around the band fixing ring 13 is fit onto the outer circumference of the portion wherein the tip portion 14 of the toothed rod band is engaged. The teeth 12 of the helical teeth of the rod band joining means can be freely formed with a method not exemplified here, on the same portion of the tube body with a known technique such as uplifting a portion of the outer circumference of the tube body to form a tooth.

The case 7 fixed on the rod side of the winding position of each toothed rod band 3 has a side guiding face 17 on both sides to guide the side face of the toothed rod band 3, and a back guiding face 16 to guide to back face of the rod band, are provided thereto. The side guiding face 17 and back guiding face 16 guide the side faces and back face of the toothed rod band 3 so that the toothed rod band 3 neatly winds up in a spiral manner, or assists in unwinding. The toothed rod band 3 on the left and right are both wound in a spiral manner in the same direction, and the movement force to move the tube body 10 in the axial direction works in the same direction and is dispersed to the each side guiding faces 17. Accordingly, as the number of rod bands increase, the load each side guiding face must bear is decreased.

A rod operating device 11 is provided on the inner side of the winding portion of the toothed rod band 3 on the right side. One toothed operating band 19 is wound dextrorsely onto the tube body 10 from the leftward side of the tube body 10 to the rightward side, and hangs down from the front side of the tube body at the operating side case 7' toward the lower side. The toothed operating band 19 is a toothed belt of the same width and having the same teeth as the toothed rod band 3. The end portion of the toothed operating band 19 is joined with the outer circumference of the tube body 10 similarly as with the toothed rod band 3, and is smoothly wound onto the outer circumference of the back side (right side) of the winding thereof. A fixed ring 18' is fit into the outer circumference of the engaging portion between the tip portion of the toothed operating band 19 and the teeth 12' of the tube body side, so as to be securely fixed thereto. The toothed operating band 19 hangs down lower than the front portion of the tube body 10, and the lower edge portion 20 is joined to the reverse side of the moving rod 2. The operating side case 7' fixed to the winding portion of the toothed operating band 19 has a side guiding face 17' on both sides thereof and a back guiding face 16' on the back face side thereof, whereby the toothed operating band 19 is also guided similarly as with the toothed rod band 3. The winding and unwinding of the toothed operating band 19 generates sideward movement force in the same direction as each toothed rod band 3, whereby each side guiding face disperses the sideward force.

As shown in the diagram, when the moving rod 2 is lowered and the toothed rod band 3 are fully unwound, the toothed operating band 19 is fully wound up. Also, when the toothed rod band 3 is fully wound up and the moving rod 2 is fully raised, the toothed operating band 19 is fully unwound.

A stopping piece 21 of rod stopping means 20 is provided in the space formed between the lower portion of the tube body 10 and the floor wall of the upper rod 1, on the inner side of the toothed operating band 19 of the operating side case 7'. A key-groove-like guide groove 22 is provided on both side faces of the side guiding face 17' along the curved surface of the outer periphery of the tube body 10. The stopping piece 21 is of roughly the same width as the toothed operating band 19, and has a key-shaped guide protruding portion 23 which fits into a guide groove 22. Thus, the stopping piece 21 is guided to the guide groove 22, and can move to the forward and backward along the outer circumference of the tube body 10 between the back guide face 16' and a back stopping face 24. The upper portion of the stopping piece 21 forms a curved face along the outer circumference of the tube body 10, the lower portion thereof is formed into a flat surface, and the front face portion thereof has tooth faces 25 which is engageable with the teeth of the toothed operating band 19. The back guide face 16' is formed as a flat surface sloping down forward. The guiding means for guiding the front/back movement of the stopping piece 21 is not limited to this particular embodiment.

Figure 6:
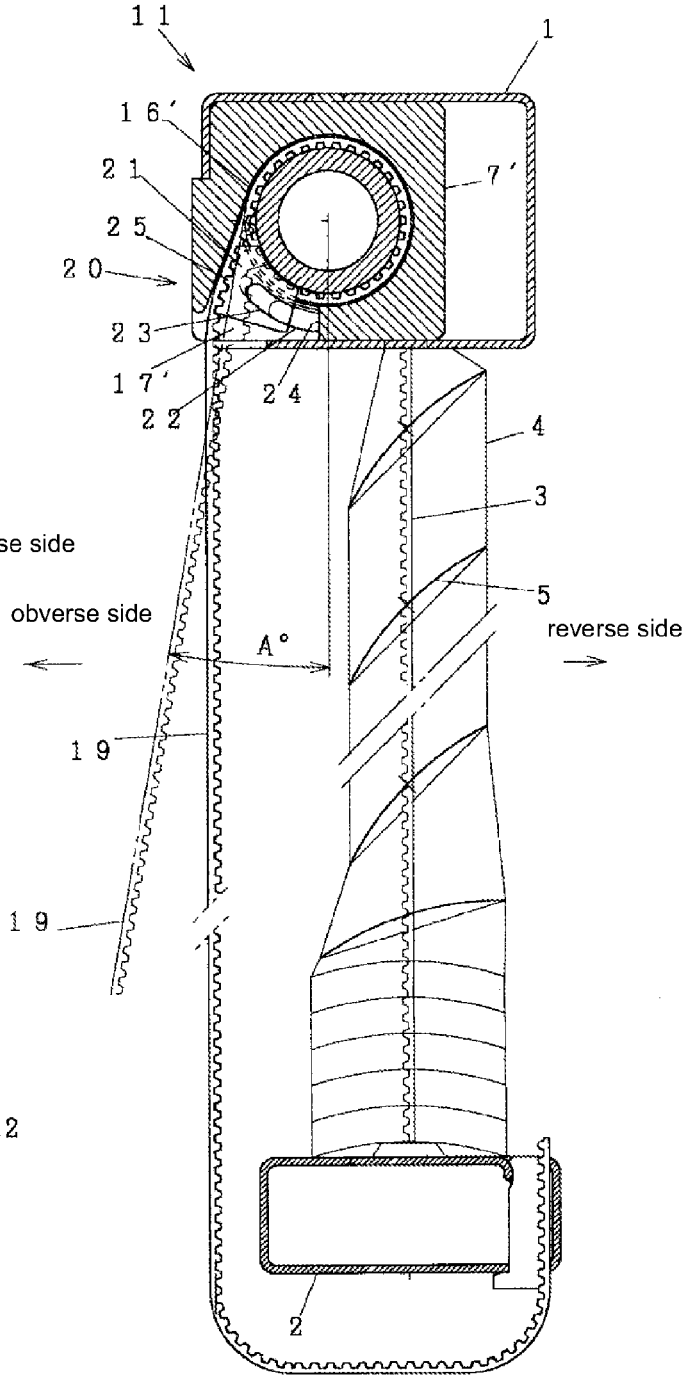
FIG. 6 is a cross-sectional view along 6-6 in FIG. 1.

As shown in FIG. 6, by sloping and pulling the toothed operating band 19 toward the front with an angle greater than the sloping angle A, the tooth face 25 separates from the tooth of the toothed operating band 19, and the stopping piece 2 retreats to the back stopping face 24 as indicated by a virtual line and stops at that position by its own weight. The moving rod 2 can be moved vertically by pulling or returning the toothed operating band 19 while maintaining the slope angle. If the toothed operating band 19 is more inward than the sloping angle A and is returned to the top with the pulling force from the rod weight, the toothed operating band 19 has the tooth faces of the inner side thereof to engage with the tooth faces 25 of the stopping piece 21 and pulls the stopping piece 21 upward, and is held so as to be sandwiched itself between the stopping piece 21 and the back guide face 16'. Thus, the present invention is made up of a simple configuration, enabling accurate and stable parallel holding with proper winding, and quiet and smooth raising/lowering movement operations to be performed. Also, the present invention has a rod operating device wherein rod movement and holding operations are simple, and can be accurately performed.

Figure 4:
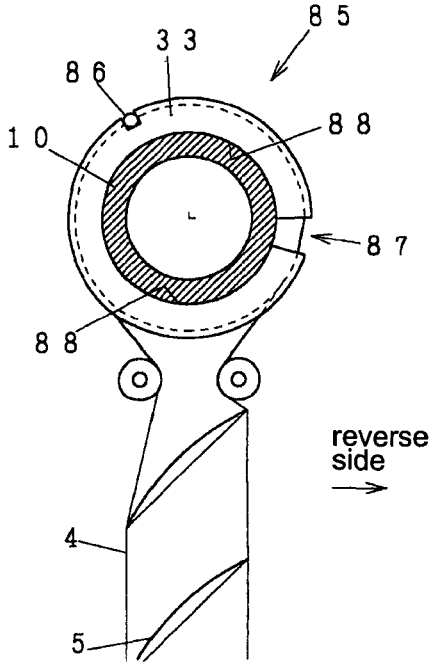
FIG. 4 is a cross-sectional view along 4-4 in FIG. 2.
Figure 5:
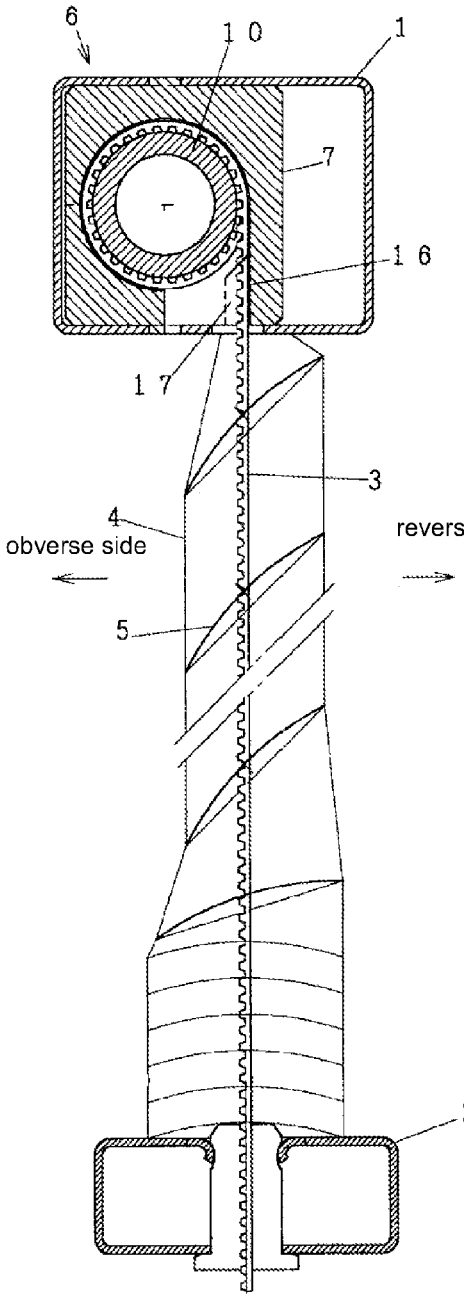
FIG. 5 is a cross-sectional view along 5-5 in FIG. 1.

FIG. 4 illustrates a blade operating device 85 wherein an operating ring 33, which is rotatable between the case 7 of the tube body 7 and the operating side case 7', and is slidable in the shaft direction, is fit therein. One axial direction groove is provided on the outer circumferential portion of the operating ring 33, whereby the upper edge of the front side and back side of the blade holding cord 4 pass through a cord groove on the outer circumference of the operating ring so as to hook onto a fixed pin 86 which is fit into each axial direction groove and joined. At one location of the periphery of the operating ring 33 the outer circumferential portion is cut open in the axial direction and a grasping open/close end portion 87 is formed therein, and the inner circumferential portion of both sides thereof has a friction inner face portion 88 formed therein. The operating ring 33 is made up of a material having an appropriate amount of elasticity and friction resistance, and is made to be smaller than the tube body so as to expand the hole in the event of being fit into the tube body, whereby the repulsion from this hole expanding deformation becomes grasping force means. With the repulsion from the hole expanding deformation, the friction inner face portion 88 grasps the outer circumference of the tube body 10 with a fixed amount of grasping force, obtaining force for maintaining the slope of the blade.

Figure 7:
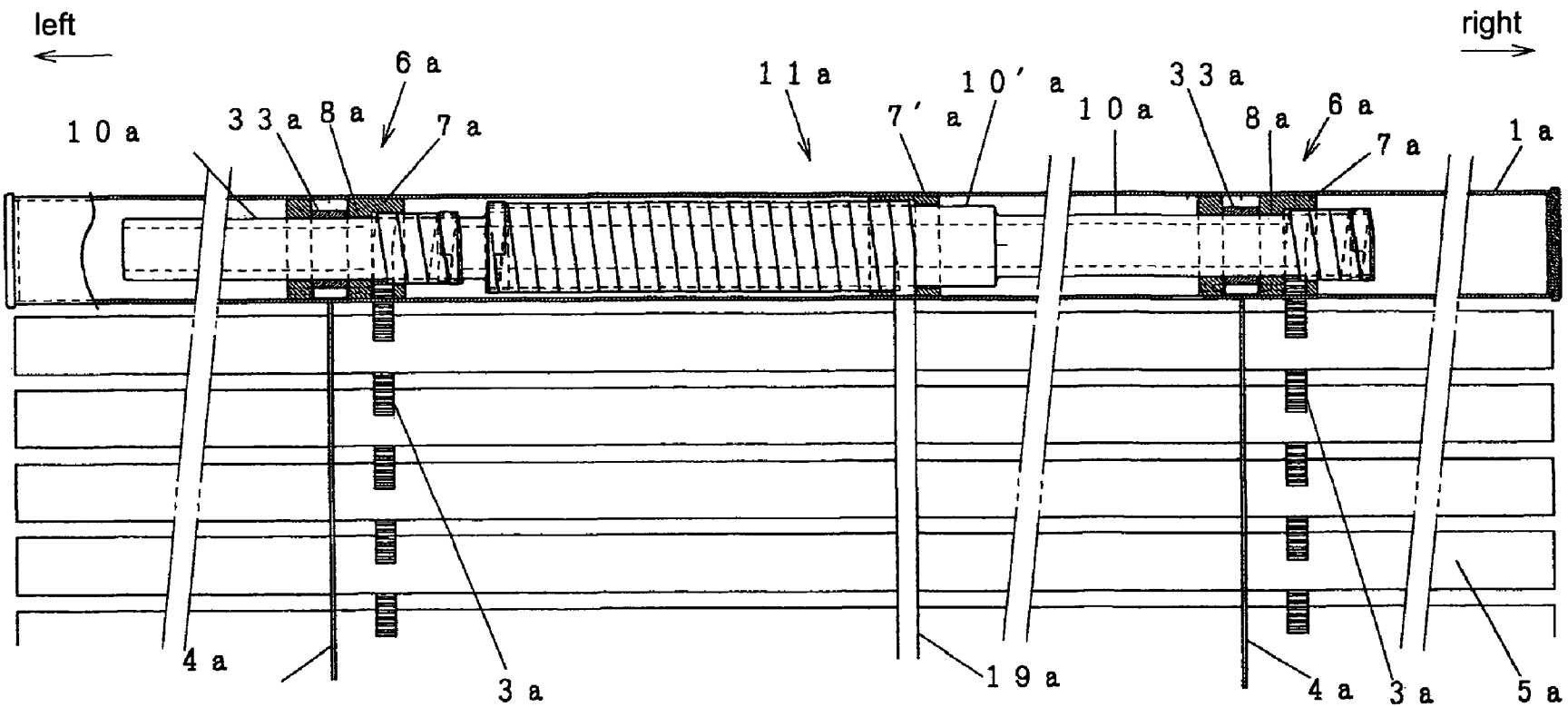
FIG. 7 is a diagram illustrating a frontal view of the upper portion of a blind according to another embodiment, partially cutaway.

FIG. 7 illustrates another example. In the description of the examples hereafter, portions similar to the preceding description will be notated with a, b, c after the same reference numeral for each example, the detailed description thereof will be omitted, and the description will be focused on different portions. Here, the portion differing from the above-described example is that the diameter of an operating tube 10'*a* portion on which a toothed operating band 19*a* of the rod operating means is wound is greater than the diameter of the tube portion 10*a* on which the toothed rod band 3*a* are wound. Thus, the force for operating the toothed operating band 19*a* can be reduced. Also, the hanging length of the toothed operating band 19*a* when the moving rod is pulled up can be adjusted to an appropriate length.

Figure 8:
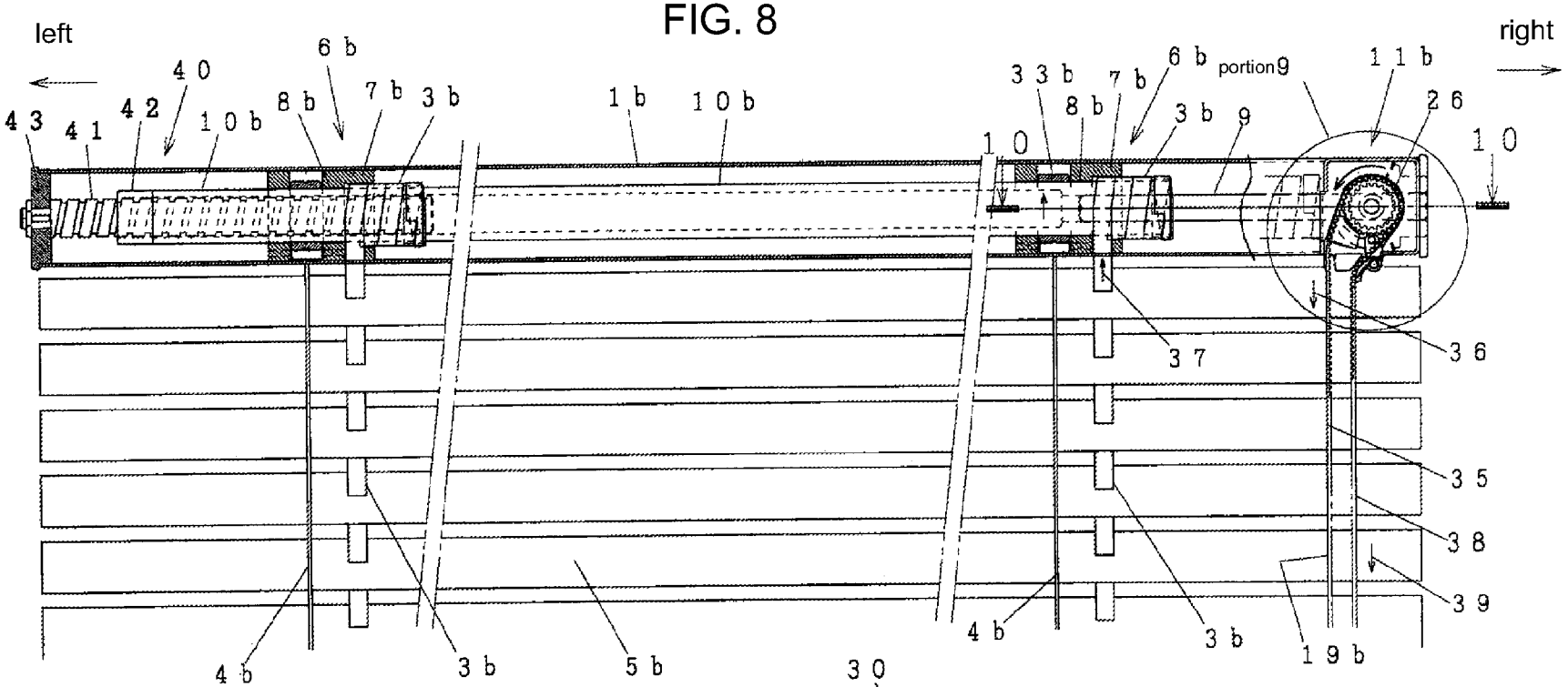
FIG. 8 is a diagram illustrating a frontal view of the upper portion of a blind according to another embodiment, partially cutaway.
Figure 9:
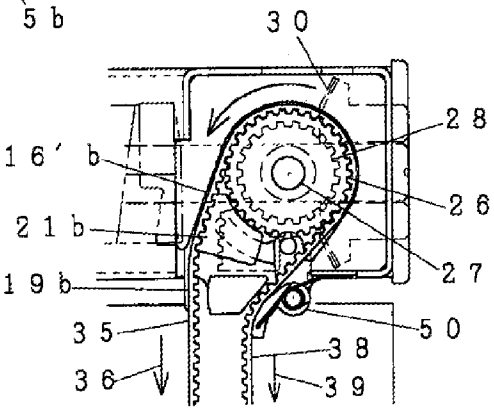
FIG. 9 is a diagram with portion 9 in FIG. 8 enlarged.
Figure 10:
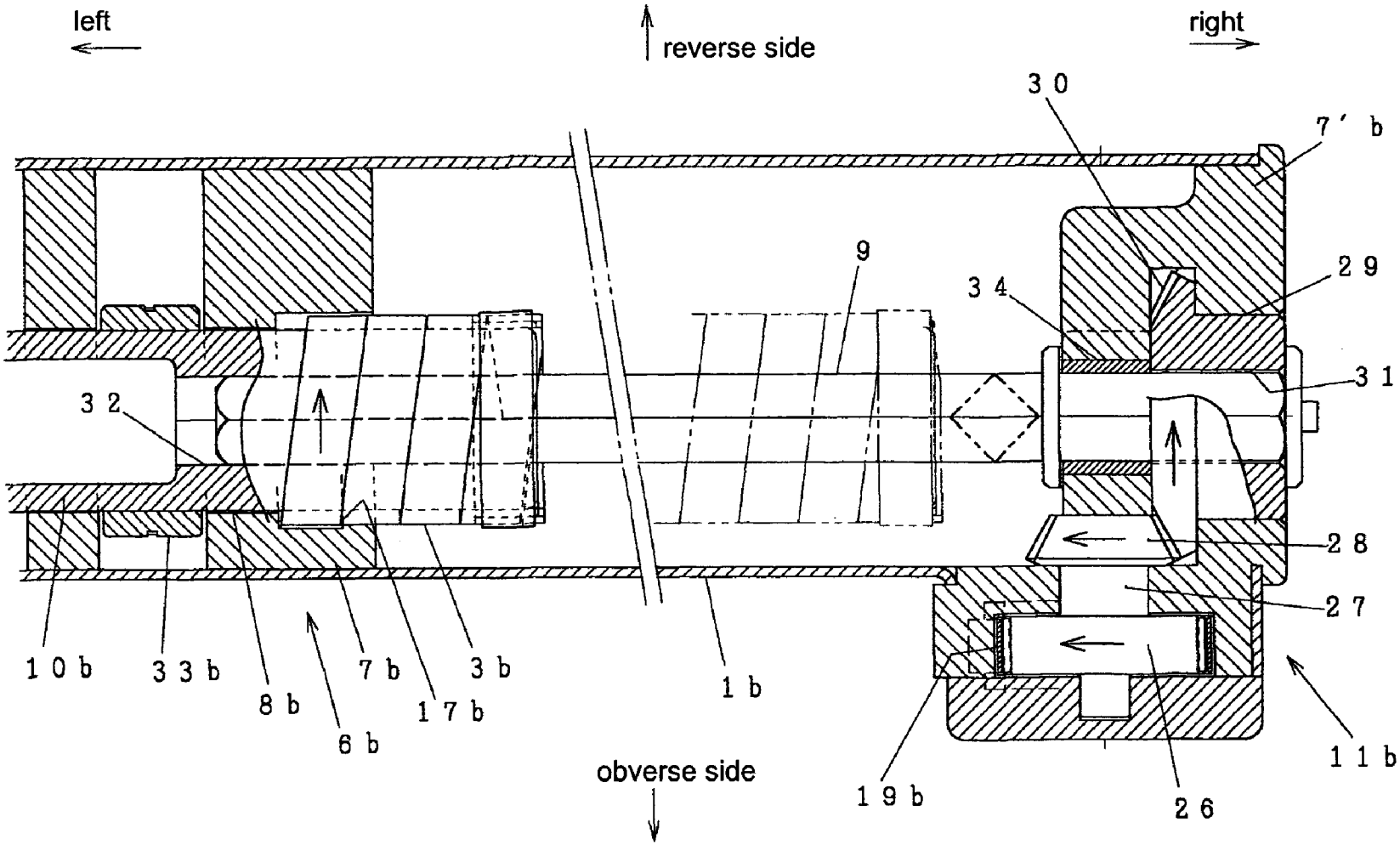
FIG. 10 is a cross-sectional view along 10-10 in FIG. 9.

The tooth faces on each toothed rod bands 3*b* in FIGS. 8 through 10 face the back side of the blinds, and hang down to the moving rod 2 from the front side of the tube body whereupon the toothed rod band 3*b* is wound sinistrorsely from the right side of the tube body 10*b* towards the left side. A rod operating device 11*b* including rod stopping means are provided on the right side of the upper rod 1*b*.

The rod operating device 11*b* has attached thereto an operating gear 26 on the front side face of the upper rod 1*b*, at right angles to the tube body 10*b*, which joins with the tube body in a rotationally joining manner via a gear transmit mechanism. An operating gear 26 having a cylindrical supporting shaft 27 which make a right angle with a transmitting shaft 9 is rotatably fit in the operating case 7'*b* fixed at the right edge portion of the upper rod 1*b*. The operating gear 26 has a small bevel gear 28 on the back side of the supporting shaft 27 so as to be formed in an integrated manner. On the edge portion of the right side of the operating case 7'*b*, a large gear 30 is fit so as to rotatably support the boss portion 29, which is engaged with the small bevel gear 28. The large bevel gear 39 and the tube body 10*b* are rotationally joined by the transmission shaft 9 of a quadrangle shaft cross-section. That is to say, a driven square hole 32 fitting into the transmission shaft 9 on the right side central portion of the tube body 10 is provided. On the other hand, the same driven square hole 32 fitting into the transmission shaft 9 on the right side central portion of the tube body 10 is provided. The right side of the transmission shaft 9 is fixedly held at the driving square hole 31 of the large bevel gear 30, and the left side thereof is slidably inserted in the shaft direction of the driven square hole 32. Thus, the rotation of the large bevel gear 30 are transmitted to the movement in the shaft direction via the transmission shaft 9. A bushing 45 fit into the transmission shaft 9 rotatably supports the transmission shaft 9 within the operating case 7'*b*. Thus, when the pulling side 35 of the toothed operating band 19*b* is pulled downward as shown by the arrow 36, the stopping piece 21*b* separates from the toothed operating band 19*b* and retreats, whereby the operating gear 26 and small bevel gear 28 are rotated in the arrow direction to turn the transmission shaft 9 in the arrow direction. The tube body 10*b* winds up the toothed rod band 3*b* along with the transmission shaft 9 as shown by the arrow 37, and raises the moving rod which is joined therebelow. Upon the slack side 38 of the toothed operating band being pulled in the lower direction as with the arrow 39, the stopping piece 21*b* advances and engages with the toothed operating band 19*b*. Thus by returning the pulling side 35, the toothed operating band 19*b* is locked between the stopping piece 21*b* and a back guiding face 16'*b*, and the moving rod is maintained in its own position.

A tube lead screw device 40 is provided on the left end of the upper rod 1*b*. A lead screw shaft 41 which extends deeply into an empty hole in the tube body is fixed in a position to match the axis center of the tube body 10*b* of the end portion cover 43. The pitch of the screw of the lead screw shaft 41 matches the winding pitch of the toothed rod band 3*b* wound onto the tube body 10*b*, and also is a spiral groove in the same direction as the winding direction of the toothed rod band 3*b*. A nut 42 adhered to the left end face of the tube body 10*b* is fit into the lead screw shaft 41 concentrically. Thus, when the tube body 10*b* is rotated at the time of winding up or unwinding the rod band, the tube body is led in the axial direction with a pitch matching the winding pitch of the toothed rod band, with the lead screw shaft 41, wherein all of the toothed rod bands 3*b* are wound spirally onto the tube body without sideways movement occurring, and unwound. The pitch of the screw in the lead screw shaft 41 may be the same as the winding pitch of the toothed rod band, but if there is a side guiding face 17*b* which is slightly large, some amount of space occurs between the toothed rod band to be wound. It will be clear to one skilled in the art, that in addition to the example shown here, the tube lead screw device 40 may provide a lead male screw portion on an arbitrary position of the outer circumference of the tube body 10*b*, wherein a nut fitting into the male screw portion may be provided so as to be fixed on the rod side. Thus, by properly and accurately winding, accurate and stable parallel holding, as well as quiet and smooth raising/lowering moving operations can be performed.

Figure 11:
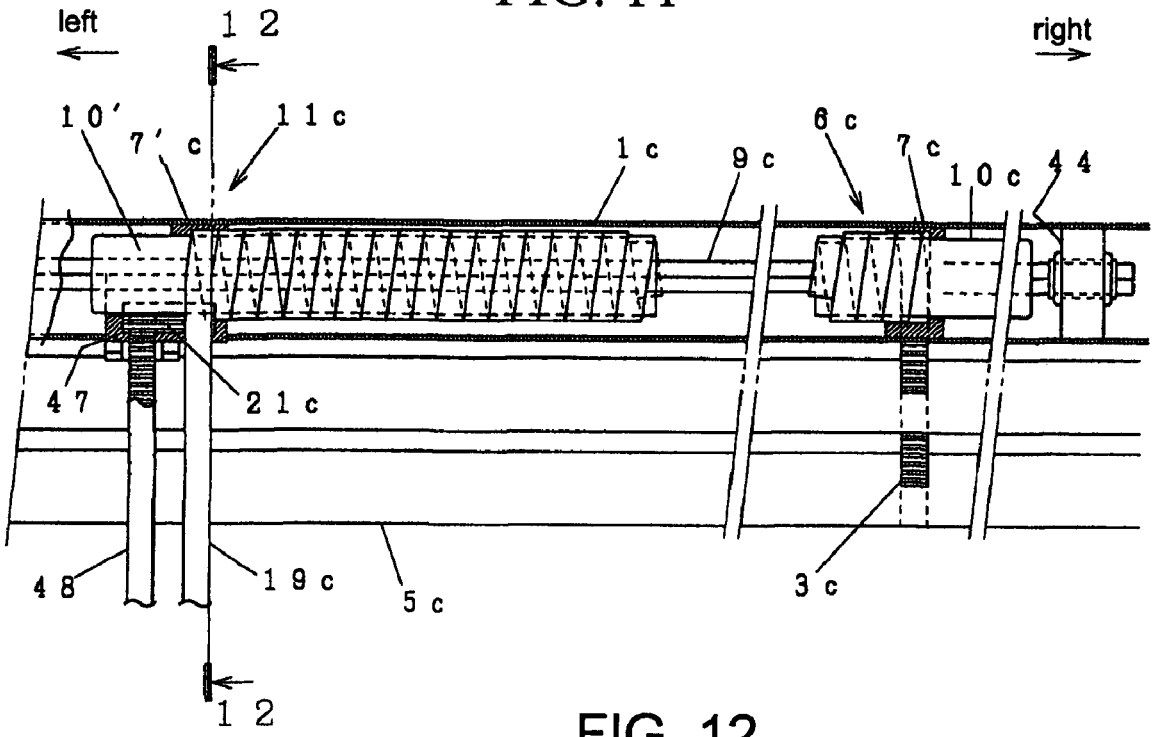
FIG. 11 is a diagram illustrating a frontal view of the upper portion of a blind according to another embodiment with the left side portion omitted, partially cutaway.
Figure 12:
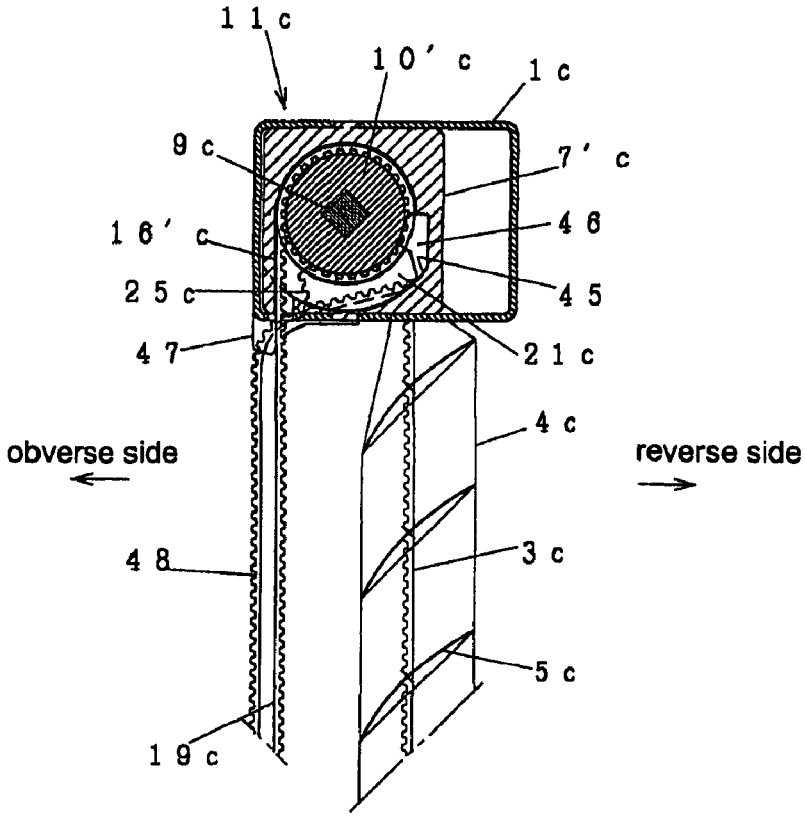
FIG. 12 is a cross-sectional view along 12-12 in FIG. 11.

With respect to the examples in FIGS. 11 and 12, the left side of the blind, which is symmetrical to the right side, is omitted. Now, the difference from the first example is that the tube body 10*c* and operating tube body 10' are rotationally joined and held, so as to be movably in the axis direction of the horizontal shaft 9*c* which is supported in a rotatable manner by the bearing 44 within the upper rod 1*c* and can be simultaneously rotated with the horizontal shaft. The horizontal shaft 9*c* has a quadrangle shaft cross-section, and the tube body side is fit with a quadrangle hole. The tube 10*c* and operating tube body 10'*c* are individually provided on the horizontal shaft 9*c* for every toothed rod band 3*c* and toothed operating band 19*c*. Rotation and stopping of the rod operating device 11*c* is transmitted to each tube body 10*c* via the horizontal shaft 9*c*, and similar to the above example, upward/downward movement and holding of the moving rod is performed by the toothed rod band 3*c* which is wound onto the tube body 10*c*. Further, the rod operating device 11*c* differs from the first example by having a rod stopping means portion. On the lower portion of the operating tube body 10'*c*, a guide recession 45 in a half cylinder shape concentric with the operating tube body 10'*c*, whereby a half-ring shaped space 46 is formed between the operating tube body 10'*c*. A stopping piece 21*c* which is swingably guided in the front and back directions is provided within the space 46. A locking band 48, which hangs down a fixed length parallel with the toothed operating band 19*c*, along the band guiding unit 47 of the operating case 7'*c* toward the front side, is adhered to the wide portion adjacent to the stopping piece 21*c*. When the toothed operating band 19*c* continues being pulled downwards, the stopping piece 21*c* is released from the locked state thereof by gravitational force and retreats, whereby the toothed operating band 19*c* can be pulled back and the moving rod raised/lowered. Then by pulling the locking band 48 while grasping the toothed operating band 19*c*, the stopping piece 21*c* advances and the tooth faces 25*c* thereof engage with the tooth of the toothed operating band 19*c*. Now, by releasing the toothed operating band 19*c*, the toothed operating band 19*c* is locked between the stopping piece 21 and the back guiding face 16'*c* by the weight of the moving rod. This is a rod operating device which can perform fine and accurate movement operations of a rod.

Figure 13:
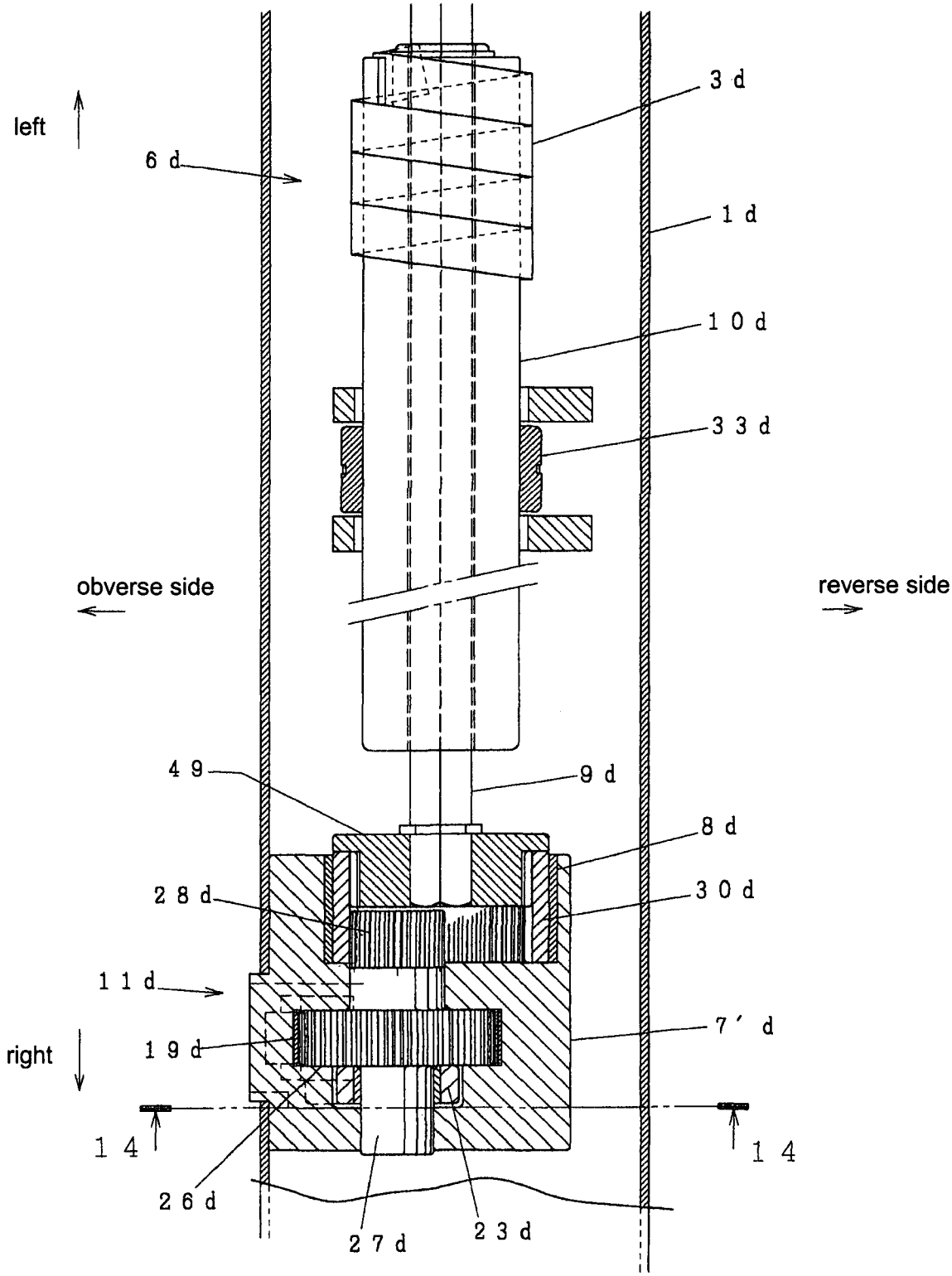
FIG. 13 is a partial plane view of the upper rod of a blind, illustrating another embodiment, partially cutaway.
Figure 14:
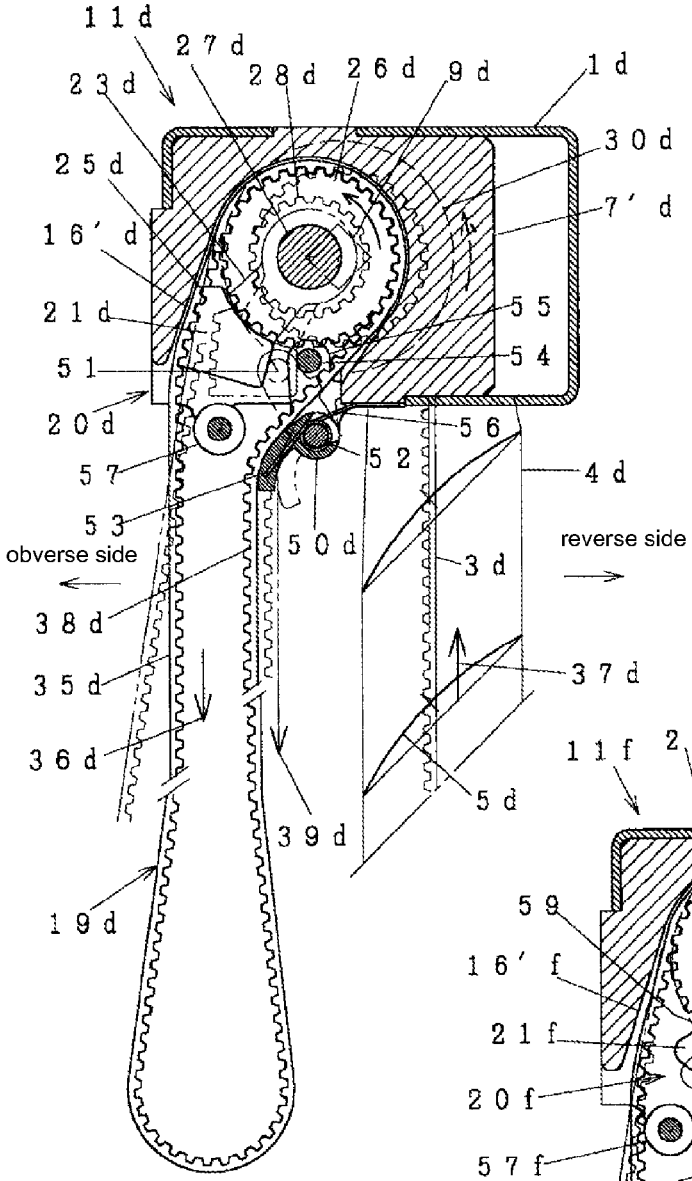
FIG. 14 is a cross-sectional view along 14-14 in FIG. 13.

FIGS. 13 and 14 illustrate the main portions of the rod operating device on the right side portion whereas the left side portion of the upper rod 1*d* is omitted. A horizontal shaft 9*d* having a quadrangle cross-section rotatably supported via a gear boss 49 of an inner gear 30*d*, is provided within the upper rod 1*d*, with one end thereof in a shaft receiver (not shown) fixed within the rod and the other end thereof in a shaft receiver 8*d* of the rod operating device 11*d*, and a toothed rod band holding device 6*d* as well as a rod operating device 11*d* including rod stopping means provided parallel thereto is provided on the horizontal shaft 9*d*. A tube body 10*d* corresponding to the toothed rod band 3*d* slides along the horizontal axis of the horizontal shaft 9*d* and rotationally joined with the quadrangle hole in the center thereof, enabling movement and rotation simultaneous with the shaft. The rod band is a toothed belt having teeth on the front side thereof, with the lower end thereof being joined with the moving rod (omitted). The upper side thereof is wound spirally on the outer circumference of the tube body 10 as shown in the diagram to configure the toothed rod band holding device 6*d*. An operating case 7'*d* is fixed on the right side portion of the horizontal shaft 9*d* which is fixed on the upper rod 1*d*, whereupon is provided an operating gear 26*d* having a supporting shaft 27*d* which rotatably fits within the operating case 7'*d*. A small gear 28*d* is formed in an integrated manner on the shaft end portion of the left side of the operating gear 26*d*. The small gear 28*d* engages with an inner gear 30*d* which firmly fits with the gear boss 49 fixed on the right side end portion of the horizontal shaft 9*d*, whereby the rotation is linked with the horizontal shaft 9*d* via the gear transmitting mechanism. The toothed operating band 19*d* of the toothed belt is wrapped over and engages the operating gear 26*d* so as to straddle in a ring shape. The portion hanging from the front side of the operating gear 26*d* of the gear operating band 19*d* becomes the rod movement operating unit on the pulling side 35*d* subjected to the weight of the rod when operating the rod.

On the other hand, the portion hanging down the back side of the operating gear 26*d* makes up a stopping operating unit at the slack side 38*d* which passes through the band guiding face 53 of the push-out lever 50 and hangs down. A stopping piece 21*d* which swings forward and backward is provided in the space under the operating gear 26*d*. The stopping piece 21*d* is formed so as to be integrated with the end of an arm portion 23*d* which is swingably fit into the support shaft 27*d* portion on the right side of the operating gear via a bearing so as to protrude toward the operating gear side, and slides around the support shaft 27*d*, guided by the arm portion 23*d*. Tooth faces 25*d* which is engageable with the teeth of the toothed operating band 19*d* are formed on the front side of the stopping piece 21*d*, and the back side thereof forms an abutting face 51 of the push-out lever 50. The push-out lever 50 is swingably supported on the lever pin 52 horizontally fixed in the left and right directions on the operating case 7'*d* side of the lower portion of the stopping piece 21*d*. The push-out lever 50 has a band guiding face 53 which is bent in a protruding manner to receive, and guide toward the front, the hanging down portion on the back side of the partially wound toothed operating band 19*d*, in front of the lever pin hole, and a lever unit 55 having a pushing portion 54 in a pin-shape is formed on the upper portion of the lever pin hole in the sideways direction which extends toward the back side of the stopping piece. A coiled portion is fit into a portion of the lever pin 52, one end of which is inserted in the lower side of the band guiding face 53 of the push-out lever, the other end fitting a returning spring 56 of the lever returning means which is received at the lower portion of the operating case 7'*d*. Thus, as shown in the diagram, the push-out lever 50 is maintained in a state of the lever portion 55 continually abutting the wall on the back side of the operating case 7'*d* so as to stand up towards the back, with the force of the returning spring 56. A back guiding face 16', extending in the lower direction of a portion of the front side of the operating gear 26*d*, is formed on the operating case 7'*d*. An inner guiding roller 57 of the inner side guiding means wherein the front end face of the stopping piece 21*d* protrudes frontward somewhat from the tooth face 25*d* when the stopping piece retreats is provided on the lower portion of the movement space of the stopping piece 21*d*.

In FIG. 14, upon pulling the pulling side 35 of the toothed operating band as shown with the arrow 36*d*, the stopping piece 21*d* separates from the teeth of the toothed operating band 19*d* and retreats, and is maintained in a position wherein the abutting face 51 abuts against the pushing portion 54 as shown with the virtual line. The operating gear 26*d* rotates in the direction of the arrow to turn the inner gear 30*d* in the arrow direction, and by turning the tube body 10*d* via the horizontal shaft 9*d*, the toothed rod band 3*d* and the moving rod are moved up and down as shown with the arrow 37*d*. If the slack side 38*d* is pulled downward as with the arrow 39*d* which maintain the pulling side 35*d* in the position thereof, the band guiding face 53 of the push-out lever 50, as shown with a virtual line in the diagram, prevails against the force of the returning spring 56 and slopes downward, the push pin 54 advances while pushing the stopping piece 21*d* forward so that the tooth faces 25*d* of the stopping piece engage with the teeth of the toothed operating band 19*d*. By maintaining the slack side 38*d* in its state while loosening the pulling force of the pulling side 35*d*, the toothed operating band 19*d* is maintained as being sandwiched between the tooth faces 25*d* of the stopping piece and the back guiding face 16', as shown in the diagram, with the weight on the moving rod side.

Employing the force of the returning spring 56, the movements of the push-out lever 50 become quick, and by operating with fine detail of the pulling side 35*d* and the slack side 38*d*, fine movements of the moving rod can be performed. Also, minutely moving the holding ring 33*d* of the blade operating means which fit on the tube body 10*d* enables minutely adjusting the slope of the horizontal shield blade 5. Further, a rod operating device which can perform secure operations and stable return-stopping operation can be obtained.

Figure 15:
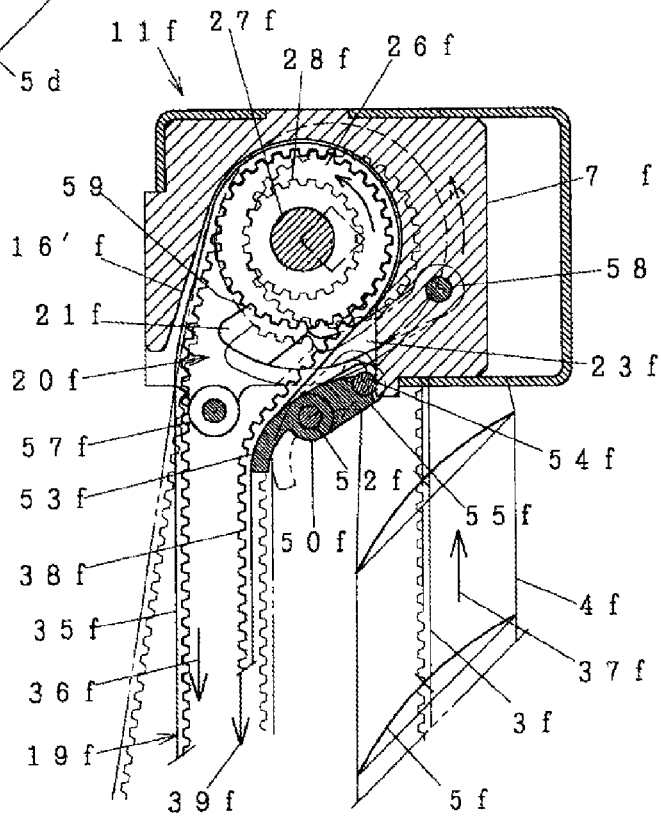
FIG. 15 is a partial cross-sectional diagram illustrating another embodiment of the part shown in FIGS. 13 and 14.

With FIG. 15, the stopping piece 21*f* holds an arm portion 23*f* extending towards the backside thereof with a supporting pin 58 of stopping guiding means, and can swing up and down within a space, guided by the support pin 58. The stopping piece 21*f* has a stopping tooth face 59 which engages with the lower side of the operating gear 26*f* on the upper face side thereof. A lever portion 55*f*, having a sideways pin-shaped push-out portion 54*f* extending in the diagonally rear direction of the lever pin hole, is formed on the push-out lever 50*f*. The lever portion 55*f* is made so as to be heavy, and the push-out lever 50*f* has the force to continually tilt in the rear direction with the weight of the lever portion 55*f*. Thus, when the pulling side 35 of the toothed operating band 19*f* is pulled downward, the stopping piece 21*f* separates from the teeth of the operating gear 26*f* and drops down. After the moving operation, in the even that the slack side 38*f* is pulled, the push pint 54*f* pushes up the arm portion 23*f* of the stopping piece, and the stopping tooth faces 59 engage with the lower side of the operating gear 26*f*, the rotation of the operating gear 26*f* is stopped and the moving rod is held. A secure rod operating device 11*f* which does not easily harm the toothed operating band 19*f* is obtained. This is a rod operating device which can finely and securely perform rod movement operations.

Figure 16:
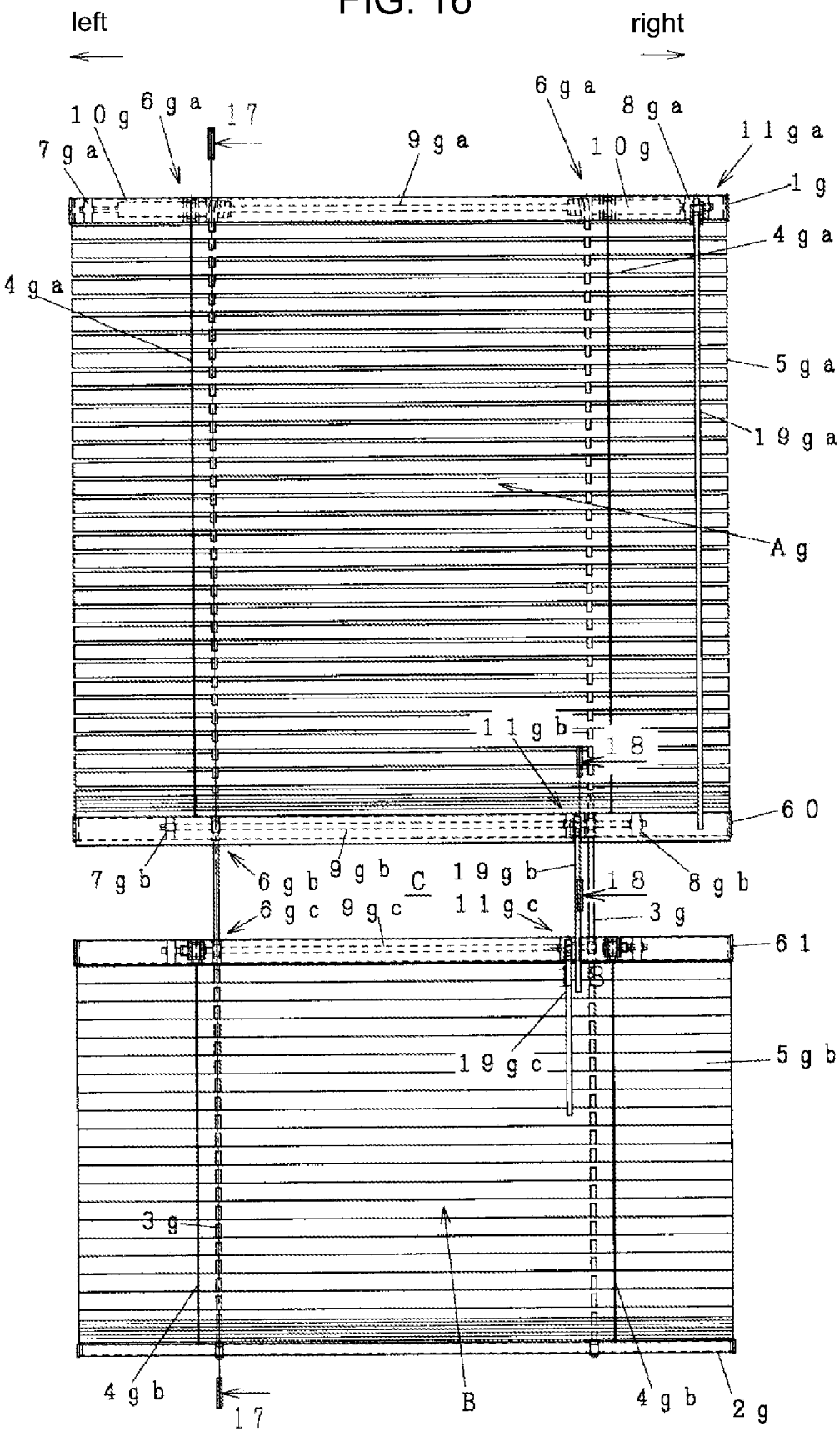
FIG. 16 is a frontal view of a blind according to another embodiment.
Figure 17:
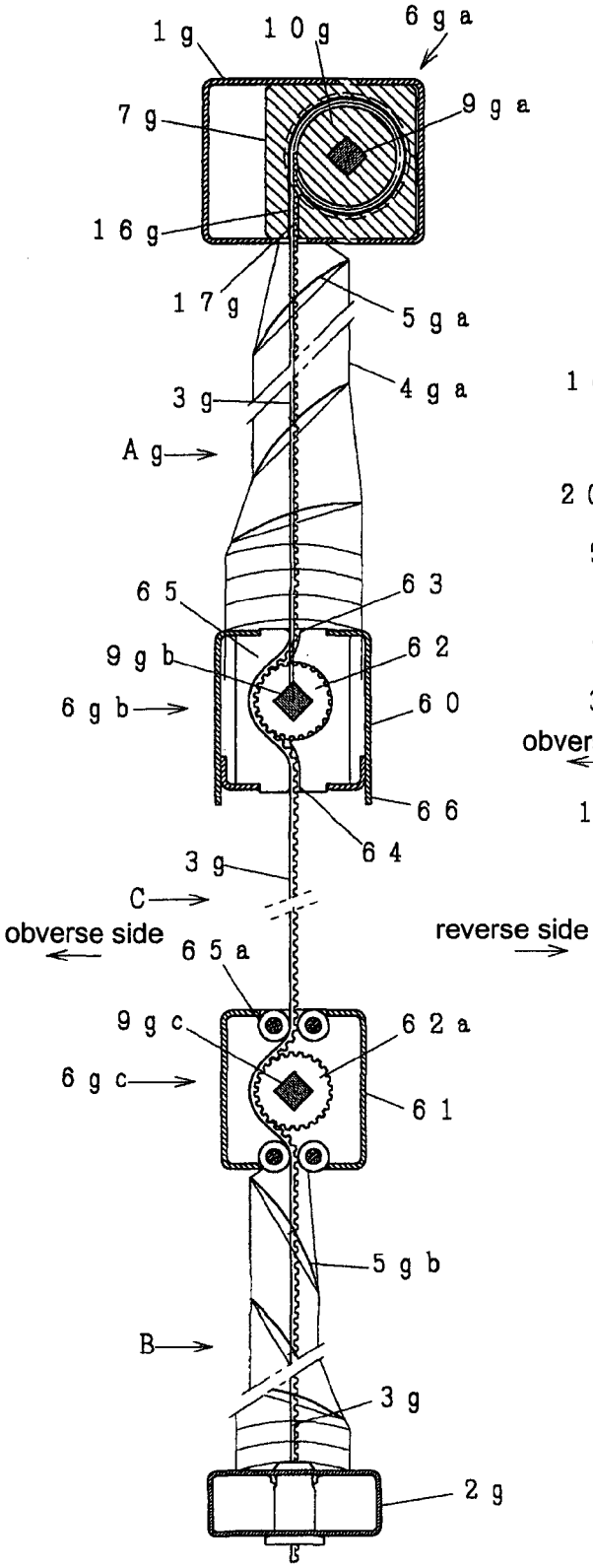
FIG. 17 is a cross-sectional view along 17-17 in FIG. 16.
Figure 18:
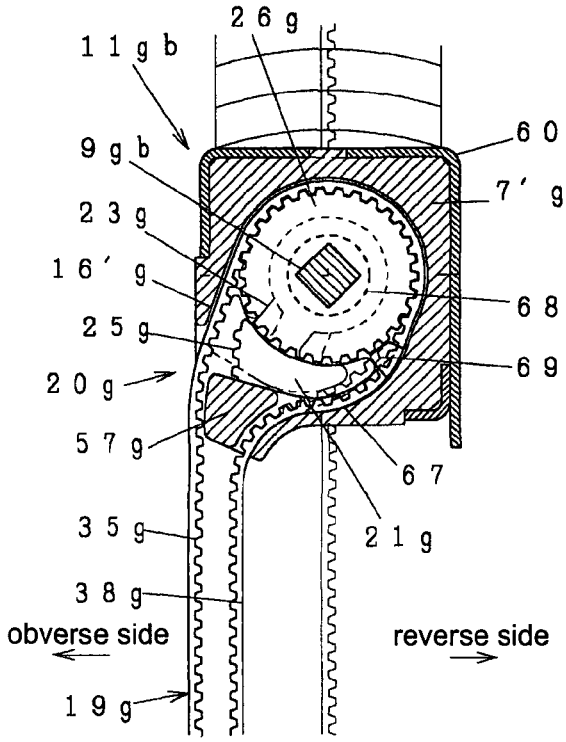
FIG. 18 is a cross-sectional view along 18-18 in FIG. 16.

In FIGS. 16 through 18, a first intermediate rod 60 and a second intermediate rod 61 are provided, each held with a toothed rod band 3*g*, in between an upper rod 1*g* and a lower moving rod 2*g* which is hold by left and right toothed rod bands 3*g* which hang down from a toothed rod band holding device 6*ga*. In between the upper rod 1*g* and the first intermediate rod 60, upper shield adjusting faces Ag are formed with upper horizontal shielding blades 5*ga* held with upper blade holding cords 4*ga*, and in between the second intermediate rod 61 and the lower moving rod 2*g*, lower shield adjusting faces B are formed with lower horizontal shielding blades 5*gb* held with lower blade holding cords 4*gb*. A view shield adjusting face C with adjustable spacing is provided between the first intermediate rod 60 and the second intermediate rod 61.

A horizontal shaft 9*gb* which is rotatably supported with the bearing 7*gb* and 8*gb* are provided within the first intermediate rod 60. On the horizontal shaft 9*gb*, a moving gear 62, which engages with the teeth of the toothed rod band 3*g*, is fixed at a position facing the respective toothed rod band 3*g*, each engaging with the respective corresponding toothed rod band. The horizontal shaft 9*gb* is positioned at roughly the center of the width in the front and back direction of the first intermediate rod, and the exit/entry 63 and 64 of the toothed rod band 3*g*, which open at the top and the bottom, pass through the same rod center position. The toothed rod band 3*g* passes through the rod which is hooked onto the front side of the moving gear 62. A guiding piece 65 for guiding the toothed rod band is provided within the rod. The guiding pieces 65 guide the back face of the toothed rod band 3*g* passing through the rod, and leads to the vertical exit/entry 63 and 64, so as to pull out vertically from the central position of the rod. Along with consideration for the center of gravity of the rod itself, by having the toothed rod band being pulled by the weight of the toothed rod band, horizontal holding of the first intermediate rod 60 may be performed. The guiding piece 65 securely holds the toothed rod band 3*g* around the moving gear 62, increases the engaging ratio with the moving gear, maintains a smooth flow of the toothed rod bands, and effectively works to maintain a horizontal sate of the front and back directions of the rods. The toothed rod band holding device 6*gb* which keeps the toothed rod band 3*g* parallel and moves up and down is formed by the horizontal shaft 9*gb* and the left and right movement gear 62 being simultaneously rotated.

A rod operating device 11*gb* is provided next to the moving gear 62. An operating case 7'*g* is provided with a deep and smooth recessed face 67 on the lower side of the operating gear 26*g*, and at the time of rod moving operation, the slack side 38*g* of the toothed operating band 19*g* moves along the recessed face 67. The stopping piece 21*g* is formed in a half-moon shape between the slack side 38*g* of the toothed operating band and the operating gear 26*g* at the end of the arm portion 23*g* which is rotatbly held on the horizontal shaft 9*gb*, via the bushing 68, is guided by the horizontal shaft 9*gb* is swingable about forward and backward. The tooth faces 25*g* which is engageable with the teeth of the toothed operating band 19*g* in the front end portion and have a push-out portion towards the back side. In the event that the stopping piece 21*g* holds the toothed operating band 19*g* between the back guiding faces 16'*g*, the inner side of the slack side 38*g* of the toothed operating band is pushed towards the recessed face 67 side with its own weight, and retreats until abutting against the stopper 69. Then in the event of stopping the pulling side 35G of the toothed operating band, if the slack side 38*g* is pulled downward, the toothed operating band along the recessed face 67 has the slack side 37*g* thereof pull taut and the push-out portion of the stopping piece 21*g* being pushed to push toward the front as illustrated by a virtual line. Then the tooth faces 25*g*, engaging with the teeth of the pulling side 35G of the toothed operating band, maintains the pulling side 35*g* between the back guiding face 16'*g*. This is clearly a simpler configuration.

With the second intermediate rod 61 side, the guiding means of the toothed operating band 3*g* is converted to a guiding roller 65*a*. The operation thereof is performed by the same rod operating device 11*gc* as exactly the same rod operating device 11*gb*, similar to other rods. A cover portion 66 is provided which protrudes downward to cover the entire sideways width on the lower portion of the front side and the back side of the first intermediate rod 60. When the view shield adjusting face C is closed, the cover portion 66 fits on the outer side of an opponent rod and working to provide shielding of minor spacings between the first intermediate rod 60 and second intermediate rod 61, as well as integrating both rods firmly. Accordingly, this is stable against wind or the like.

Thus, the present invention is a toothed rod band holding device and a rod operating device suitable for moving and holding multiple moving rods, which do not necessitate a rod holding unit for each rod.

Figure 19:
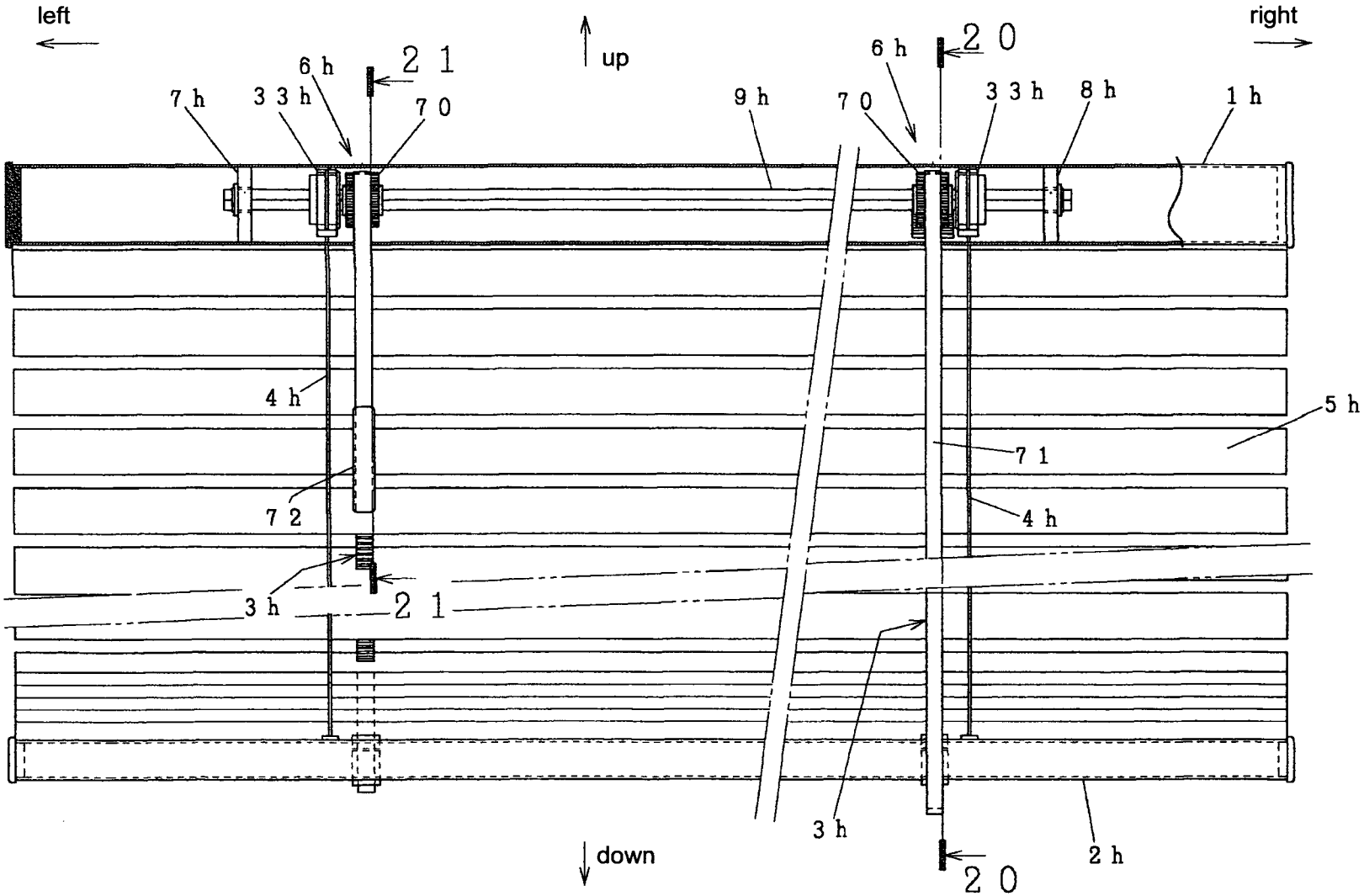
FIG. 19 is a diagram illustrating a frontal view of the upper portion of a blind according to another embodiment, partially cutaway.
Figure 20:
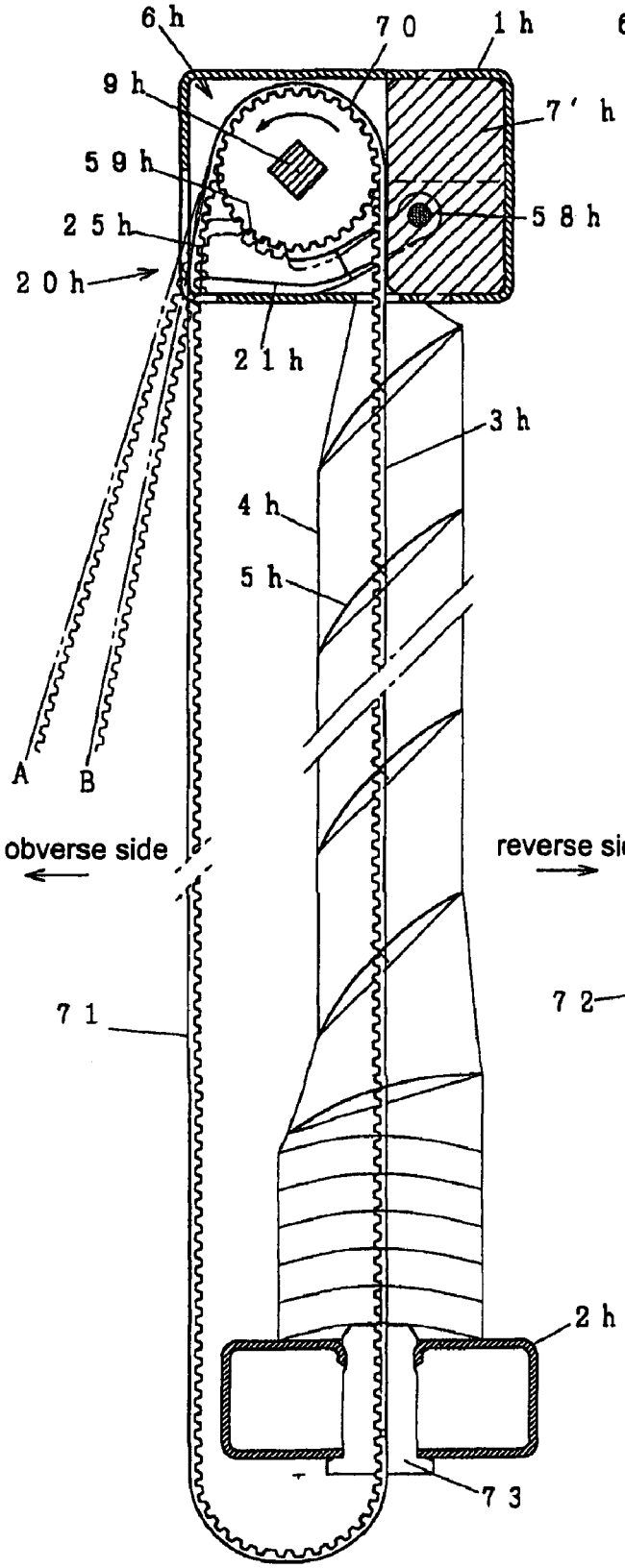
FIG. 20 is a cross-sectional view along 20-20 in FIG. 19.
Figure 21:
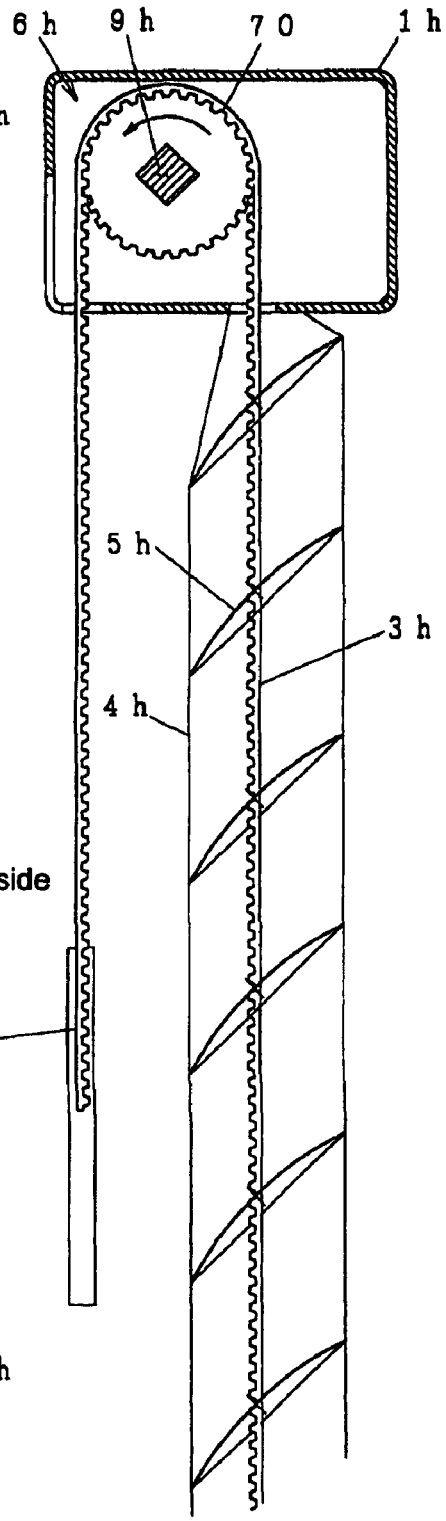
FIG. 21 is a cross-sectional view along 21-21 in FIG. 19.

In FIGS. 19 through 21, a horizontal shaft 9*h* which is rotatably borne by a bearing 7*h* and 8*h* is provided within the upper rod 1*h*, wherein a pair of gears 70 on the left and right for a toothed rod band is fixed on the horizontal shaft 9*h* in a position where the rod holding body passes. A toothed rod band 3*h* is hooked over each gear 70 so as to engage thereto, wherein the back sides of the hooking thereof pass through band holes of the horizontal shield blades 5*h* and fixed to a position corresponding to the moving rod 2*h* with a holding piece 73. On the other hand, the front side of the hooking hangs down the horizontal shield blade 5*h*. Now, of the toothed rod bands 3*h* hanging down on the front side of the horizontal shield blades, the lower end on the left side cut off to become a cutoff end 72 having a weight, and the lower end of the right side extends downward, is bent in a U-shape from the lower side of the moving rod 2*h*, and is held on the lower side of the holding piece 73, and becomes an operating-side toothed rod band 71. A long stopping piece 21*h* is provided on the lower space of the operating side gear 70 on the operating-side toothed rod band 71 side. This stopping piece 21*h* has the back portion side thereof held with a supporting pin 58*h* of an operating case 7'*h*, and is swingable up and down within a space. The stopping piece 21*h* has a tooth face 25*h* which is engageable on the front side hanging-down portion of the operating-side toothed rod band 71 facing the front face portion side of the stopping piece 21*h*, and a stopping tooth face 59*h* which is engageable with lower tooth of the operating side gear 70 facing the upper face side. When the stopping tooth face 59*h* is engaging on the lower side of the operating side gear 70, the tooth face 25*h* protrudes somewhat from the front end face of the operating side gear 70, and the operating-side toothed rod band 71 continually engages with the tooth face 25*h* and hangs down. When the operating-side toothed rod band 71 is held and pulled at the slope A, the stopping piece 21*h* is disengaged and drops to a floor plate of the upper rod 1*h* by its own weight, and the operating side gear 70 rotates in the arrow direction. Thus the gears on the left and right rotate together via the horizontal shaft 9*h*, and the toothed rod band 3*h* is moved in parallel to move the moving rod 2*h* up and down. When the operating-side toothed rod band 71 is held in the position of slope B and given slack, the teeth thereof catch on the tooth faces 25*h* and engage thereto, the stopping piece 21*h* is pulled up for the stopping tooth faces 59*h* to engage with the lower side of the operating side gears 70 and the moving rod 2*h* is held in that position. Even if the front portion of the stopping piece 21*h* has a flat surface without the tooth faces 25*h*, the operations for pulling up by the toothed rod band 71 and for engaging by the stopping tooth faces 59*h* are possible. However, when the operating-side toothed rod band 71 is engaged with the tooth faces 25*h* and hanging downward, even if an external force such as the wind works to hold up the moving rod 2*h*, the stopping piece 21*h* is strong rod-stopping means which does not easily disengage.

Thus, the rod stopping means of the rod operating device can also be arranged to stop the rod by sandwiching the front side hanging-down portion of the operating-side toothed rod band 71 between the tooth faces provided on the front face portion of the stopping piece and the back guiding face provided on the back of the front side hanging-down portion, similar to that shown in the example in FIG. 6.

The present invention is a toothed rod band holding device including the rod operating device portion, and it has a simple configuration which can perform accurate and stable parallel holding, and quiet and smooth raising/lowering operations. Also, movement operations and holding operations of the rod are easy, with the stopping operation being secure without slipping.

Figure 22:
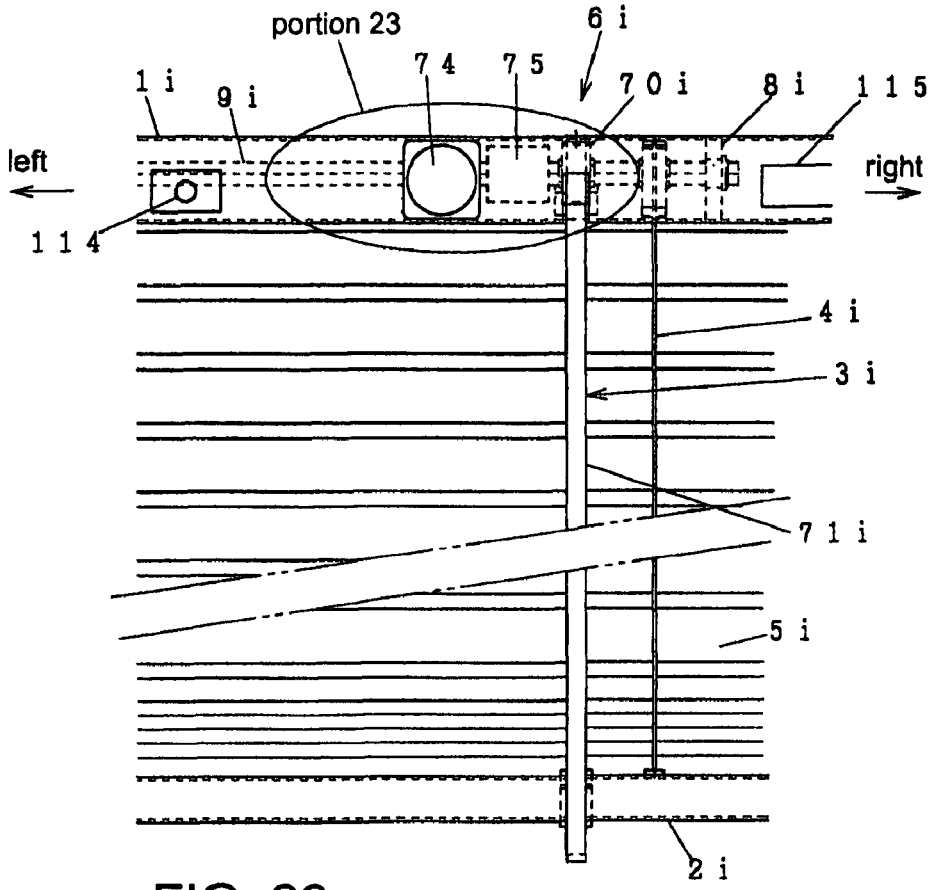
FIG. 22 is a partial frontal view of a blind according to another embodiment.
Figure 23:
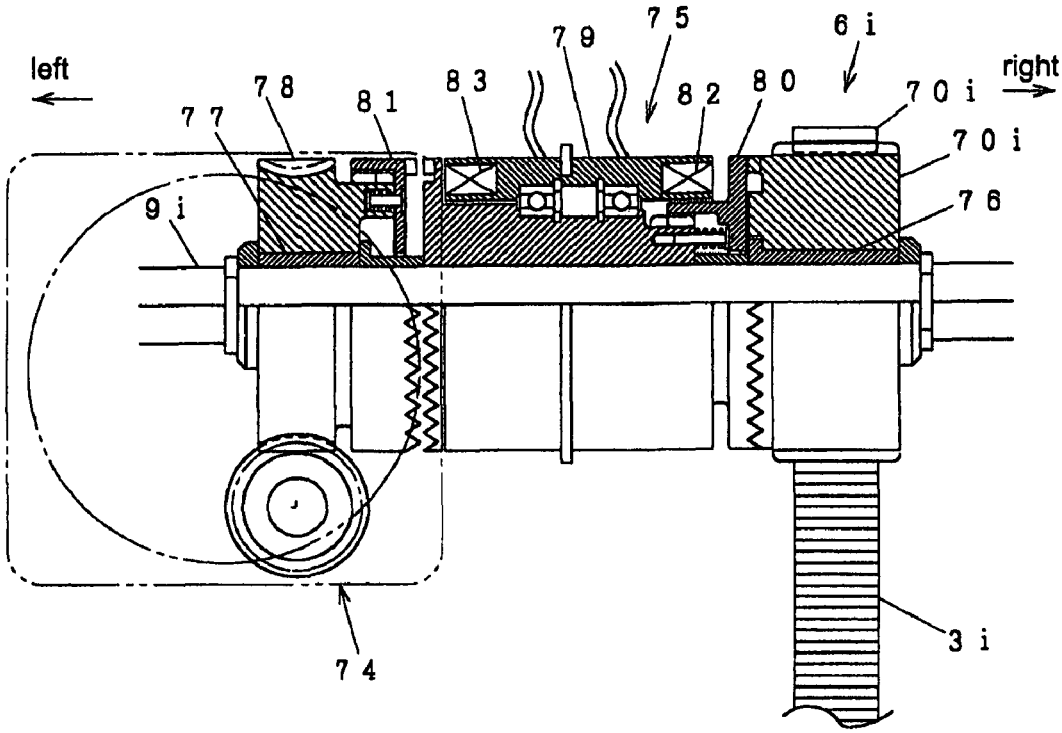
FIG. 23 is an enlarged cross-sectional view illustrating the internal device of the portion 23 in FIG. 22.

All of the rod operating devices including the intermediate moving rods can be operated with an electric motor having a control function. In FIGS. 22 and 23, the horizontal shaft 9*i* of the upper rod 1*i* has a toothed rod band holding device 6*i* provided thereto, with the toothed rod band 3*i* hooked onto the gear thereof, and an operating motor 74 is provided in the vicinity of the operating side gear 70*i* (operating cylindrical tube body) on the side of the operating-side toothed rod band 71*i*. An electromagnetic clutch 75 is provided between the operating motor 74 and operating side gear 70*i*. The electromagnetic clutch is joined with the horizontal shaft 9*i* on the operating motor side only during times of operating power being conducted, or only when the batteries are being charged, and in times of power not conducted, switches to a joining between the operating gear 70*i* (operating cylindrical tube body) side and the horizontal shaft 9*i*.

The operating side gear 70*i* on which the gear rod band 3*i* is wound on one side of the horizontal shaft 9*i* with quadrangle shaft cross-section is rotatably held via a shaft receiver 76. An electromagnetic clutch 75 is provided adjacent to the operating side gear 70*i*, and a worm gear 78 which is rotatably joined by a worm fitting into an output shaft on an operating motor 74 on the other side with the electromagnetic clutch 75 in between is rotatably held via a shaft receiver 77. The electromagnetic clutch 75 has a rotor 79 fixed in the center thereof on the horizontal shaft 9*i* side, and on the operating side gear 70*i* side is provided a magnetizing coil 82, and an armature 80 which rotatably joins the rotor 79, which engages with the clutch teeth provided on the operating side gear 70*i* with the spring force at non-conducting times of the magnetizing coil 82, and the operating side gear 70*i* side. On the other hand, on the worm gear 78 side, a magnetizing coil 83 and an armature 81 wherein the engaging of the rotor 79 is released by the spring force during non-conducting times of the magnetizing coil 83 are provided. Thus, during non-conducting times, manual operation can be performed with the operating-side toothed rod band 71*i* of the toothed rod band 3*i*. Upon the magnetizing coils 82 and 83 being magnetized by electrical conductivity, the armature 80 is absorbed into the rotor 79 side and the engaging with the operating side gear 70*i* side is released, while the armature 81 is absorbed and the rotor 79 and worm gear 78 side are rotatably joined, whereby operations can be performed with an electric motor during times of electrical conductivity. The present invention is a blind which can be operated with a remote control from a bed, or can be manually operated by going to the window. In the diagrams, the reference numeral 114 denotes the receiving unit of a remote control signal, and 115 denotes a battery.

Figure 24:
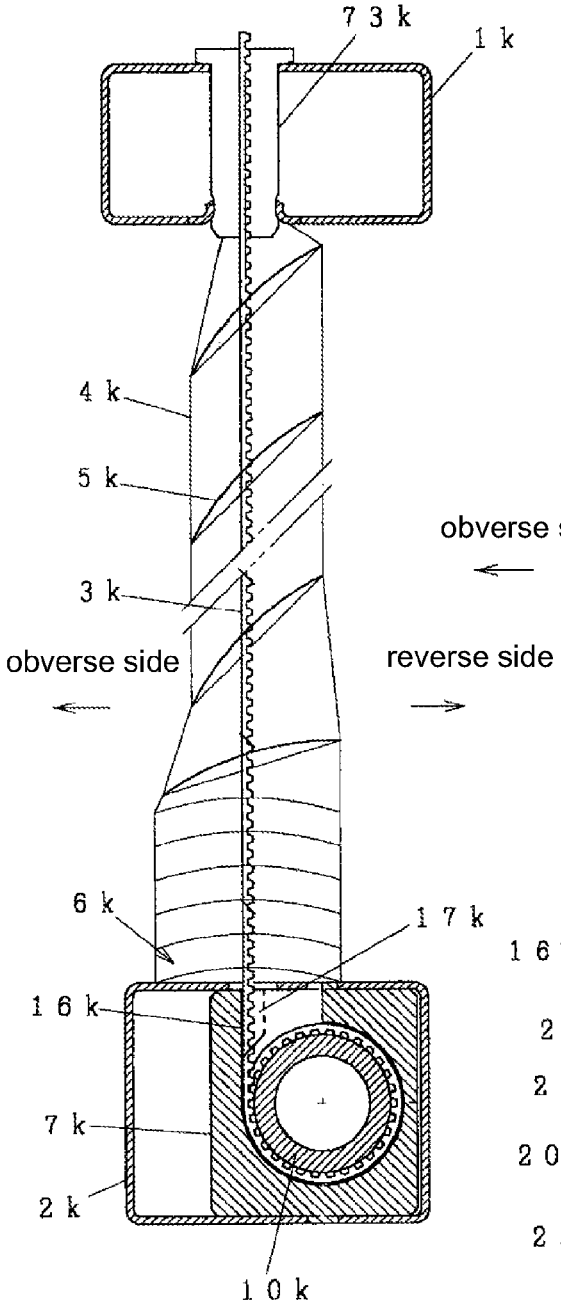
FIG. 24 is a longitudinal-section view at a toothed rod band position of a blind according to another embodiment.
Figure 25:
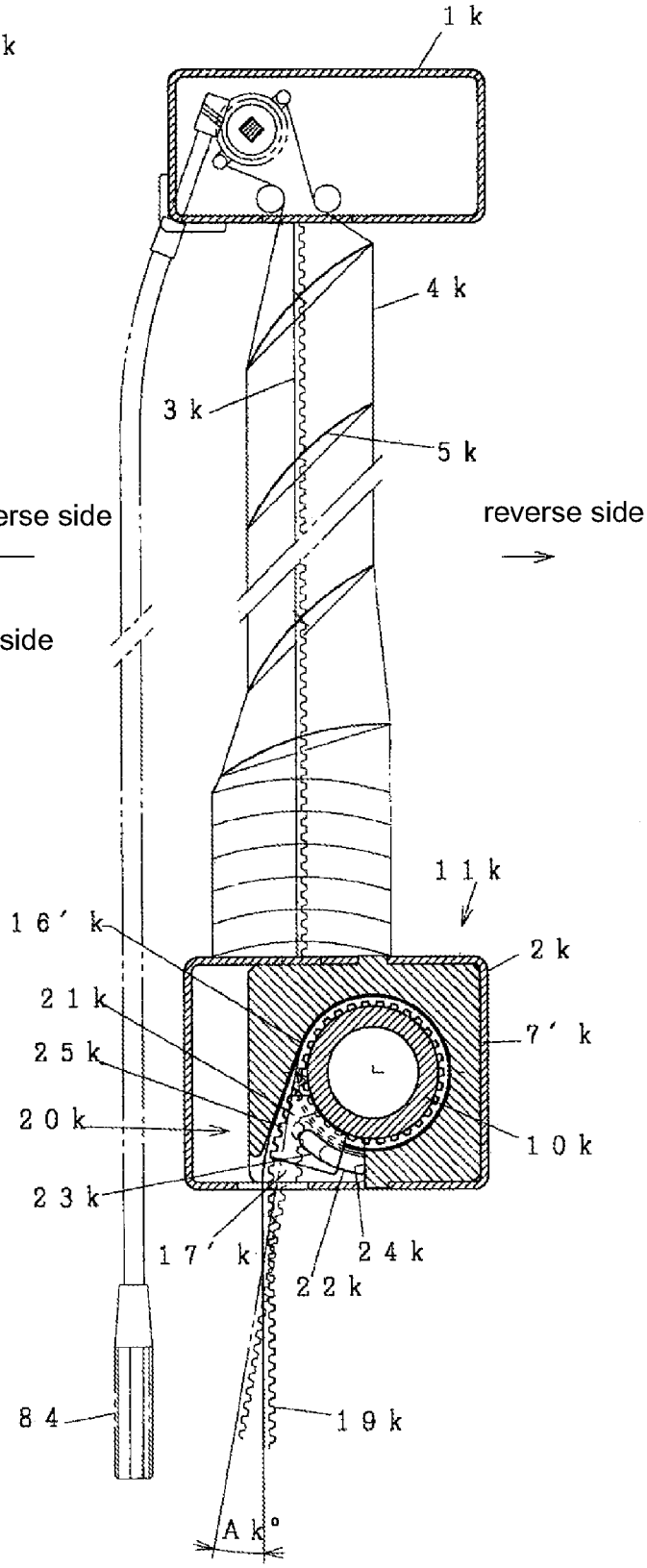
FIG. 25 is a longitudinal-section view at a toothed rod band position of a blind according to another embodiment.

FIGS. 24 and 25 are examples of the upper rod and moving rod in the first example having been reversed, wherein a toothed rod band 3*k* is fixed on the upper rod 1*k* side via a holding piece 73*k*, and provides a toothed rod band holding device 6*k* having a tube body 10*k* on the moving rod 2*k* side on the lower portion, and a rod operating device 11*k*. When operating the toothed operating band 19*k* up and down, the moving rod 2*k* also moves simultaneously in the direction opposite to the movement of the toothed operating band 19*k*. As to the position of the toothed operating band 19*k*, the center of the moving rod is desirable. This is suitable for attaching to a window of relatively short height which is in a high location. The tilting operation of the horizontal shielding blade is performed with an operating pole 84.

As to the winding of the toothed rod band of the toothed rod band holding device, the present invention is not limited to winding spirally onto the tube body as illustrated in this example. For example, an arrangement may be made wherein most generally the rod band is wound in a layered winding manner on a winding reel provided on the upper rod or the like.

When the horizontal shielding blade blinds have been opened, the slope of the blade set by the blade operating device needs to be securely maintained without being influenced by the wind and so forth. With an arrangement wherein a blade operating ring to perform the sloping operation of the blade is provided on the tube body, the range of angles of the blade slope does not reach 180, and yet grasping force of the blade operating ring is maintained over the entire rotation range of the tube body. This causes a burden on the rod moving operation, and also causes the problem of advancing attrition from the friction portion of the blade operating ring and the tube body external circumference. A blade operating device without such a disadvantage is desirable.

Figure 26:
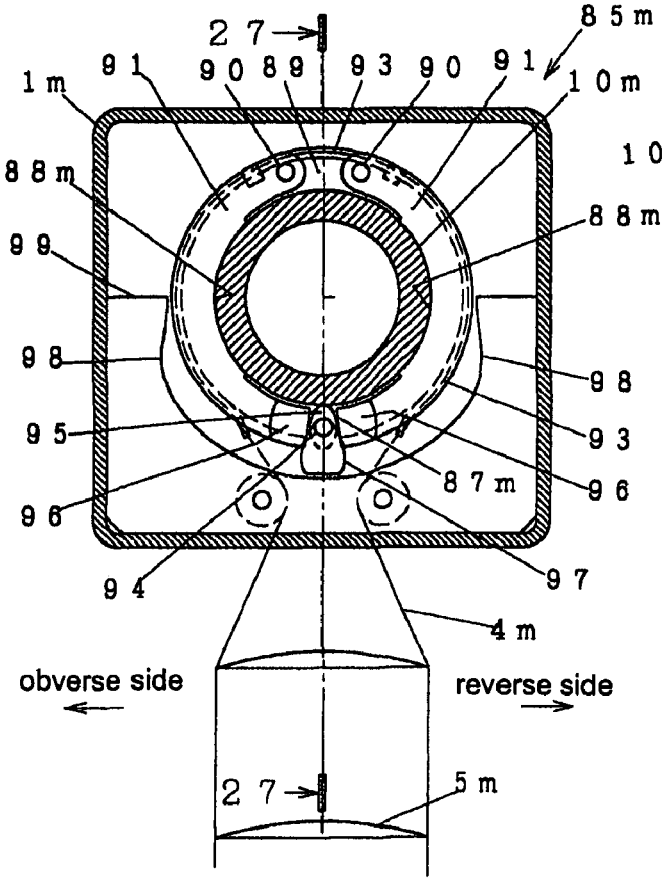
FIG. 26 is a perpendicular cross-sectional illustrating a state wherein the horizontal shielding blades are opened in an embodiment of the blade operating device.
Figure 27:
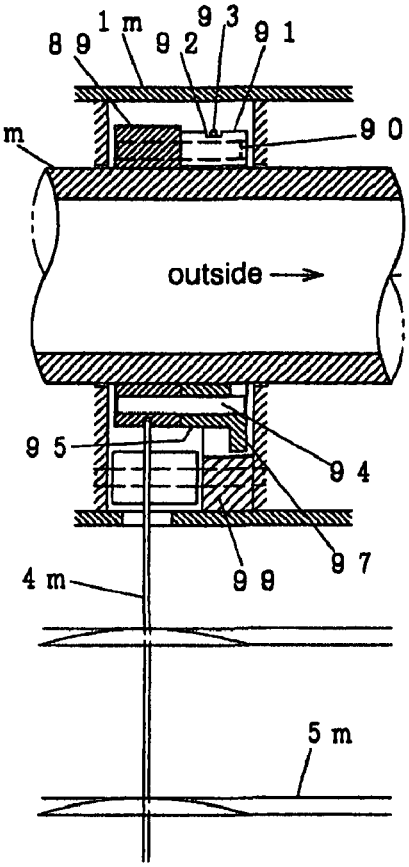
FIG. 27 is a cross-sectional view along 27-27 in FIG. 26.
Figure 28:
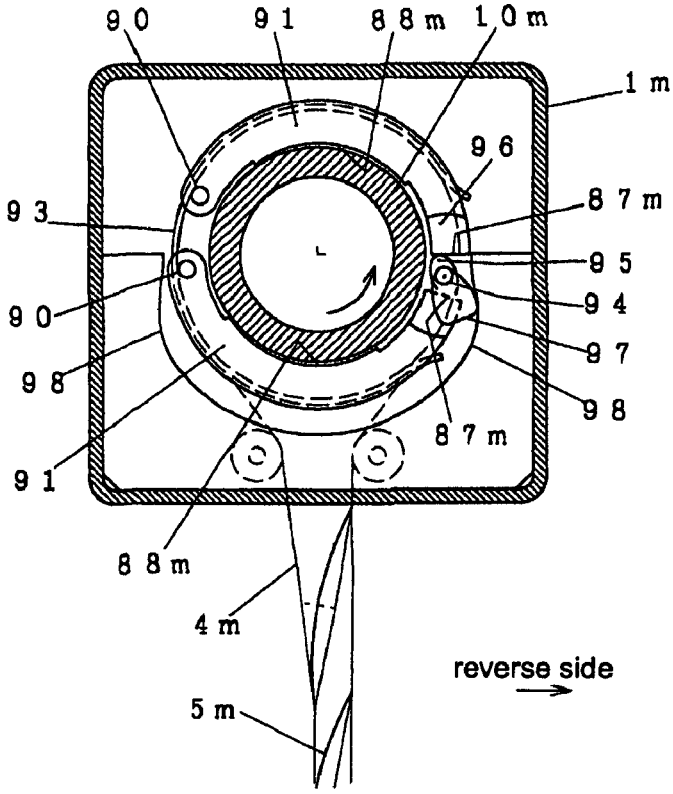
FIG. 28 is a perpendicular cross-sectional view illustrating a state wherein the horizontal shielding blades in the embodiment are facing downwards at the front side.

In FIGS. 26 through 28, the operating ring means of an blade operating device 85*m* has a ring unit 89 for holding a blade holding cord 4*m* and a portion having a friction inner circumference face 88*m*, both made as separate units but integrated via two pins. The ring unit 89 is a ring-shaped unit which fits onto the tube body 10*m* in a manner capable of rotating and also sliding in the shaft direction, wherein the upper end of the blade holding cord 4*m* is joined on the outer circumference thereof. On one side face portion of the ring unit 89, two link pins which protrude in the shaft direction are fixedly hammered in with a space in between, and a pair of friction links 91 is slidably fit into the protruding portion of the two link pins 90. the friction links 91 each have a friction inner circumference face 88*m* on the inner side thereof, and are formed in a half-ring shape with the front and back being symmetrical, so as to sandwich the tube body 10*m* from the front and back. A ring groove 92 is provided on the periphery on the outer side of both friction links 91 in the same position, and a grasping push spring 93 of a grasping force means is fit into the ring groove 92 so as to straddle both of the friction links 91. The tips of both friction links 91 are near each other and have a grasping open/close end portion 87*m* with roughly parallel and flat surfaces, as with the previous example (FIG. 4). A bridge pin 94 of a bridge holding means protruding in the shaft direction as with the link pin 90 is provided on the side face portion of the ring unit 89 between the two grasping open/close end units 87*m*. An open/close bridge of an ellipsoid tube shape extending in the shaft direction to the protruding portion of the bridge pin is fit into a pin hole passing through the center portion thereof so as to be rotatably held. A lever recessed portion 96 is provided on the side face of the outer side of the two grasping open/close end portions 87*m*. An operating lever portion 97 protruding in a reverse-heart-shape is formed so as to be integrated in the protruding portion direction of the ellipsoid on the outer side end portion of the open/close bridge 95. The operating lever portion 97 operates within the two lever recessed portions 96 around the bridge pin 94. An operating cam 99 having a cam face 98 is fixedly provided on the floor wall of the upper rod 1*m* around the operating lever portion 97.

In FIG. 26, the slope of the shielding blade 5*m* is in a horizontally open state, wherein the open/close bridge 95 is at a position directly below the tube body, and the direction of the protruding portion of the ellipsoid faces up and down vertically along with the operating lever unit 97. The operating lever unit 97 does not make contact with the cam face 98, but the ellipsoid circumferential face of the open/close bridge 95 has a small space between the grasping open/close end portion 87*m*. The two friction links 91 securely grasp the outer circumference of the tube body 10*m* with the friction inner circumference face portion 88*m* with the force of the grasping push spring 93, thereby maintaining the slope of the shielding blade 5*m*. The weight of the horizontal shielding blade 5*m* connected through the blade holding cord 4*m* is primarily transmitted from the inner circumferential face of the ring unit 89 to the upper circumferential face of the tube body 10*m*.

In FIG. 28, the ring unit 89 rotates along with the rotation of the tube body 10*m* in the arrow direction, whereby the shielding blade 5*m* is in the state of being fully sloped to the final end wherein the front is sloped down (the back side is sloped up). At this time, the grasping open/close end portion 87*m* is in a position of being sloped toward the back side of the tube body, and the operating lever unit 97 of the open/close bridge 95 widely slopes forward while making contact with the cam face 98 on the back side. The protruding portion of the ellipsoid of the open/close bridge 95 pushes open the grasping open/close end portion 87 of the two friction links 91. Thus, the friction inner circumferential face portion 88*m* positioned vertically is in a state of being separated from the outer circumferential face of the tube body, thus is released form the tube body 10*m*. Here, the tube body only has frictional resistance occurring between the ring unit 89 connected to the weight of the horizontal shielding blade 5*m*. The same can be said as the previous example also in the case of the tube body 10*m* rotating in the reverse direction. The ring unit 89 may be made out of a material superior in sliding and anti-friction properties, e.g. industrial-use plastic or the like may be used. Also, for the friction links 91, a material employed for a brake shoe or the like may be suitable.

Normally the slope of the set blade is securely maintained, and in the event of moving operations of the rod, a blade operating device excelling in anti-friction without frictional resistance can be obtained.

Figure 29:
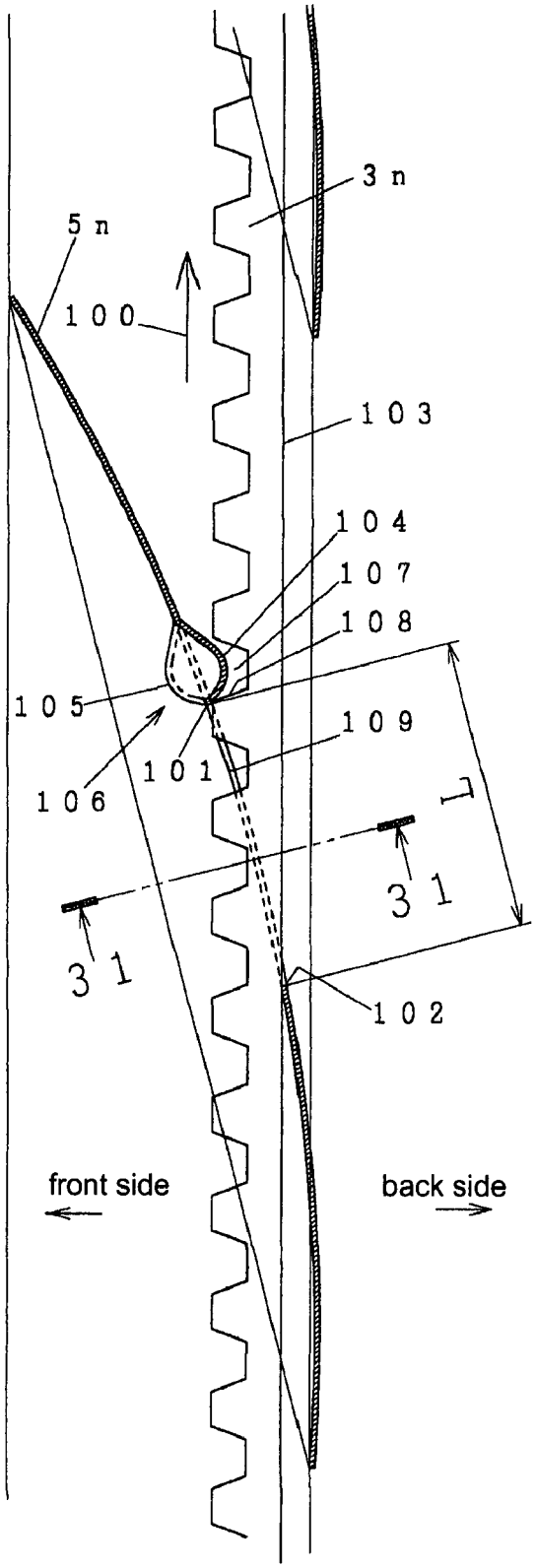
FIG. 29 is a longitudinal-sectional view perpendicular to the blades at hole portions of the horizontal shielding blades in another embodiment, illustrating a state wherein the horizontal shielding blades are facing downwards at the rear side.
Figure 30:
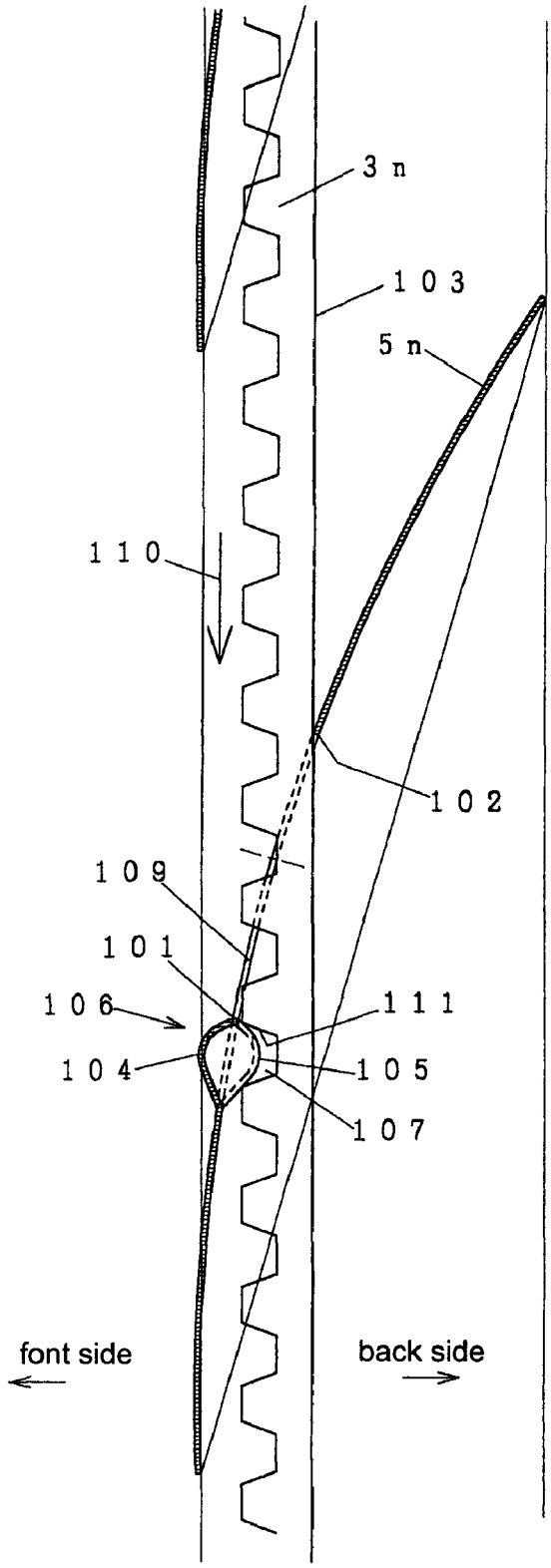
FIG. 30 is a diagram illustrating a state wherein the horizontal shielding blades in the embodiment are facing downwards at the near side.
Figure 31:
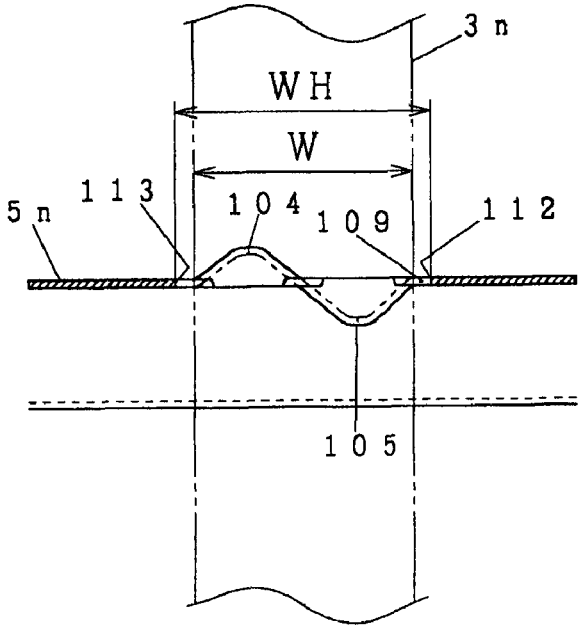
FIG. 31 is a cross-sectional view along 31-31 in FIG. 30.

Thus, with an arrangement employing a toothed rod band such as a narrow toothed belt as a rod holding body, in the event of moving the moving rod up and down in a state wherein the shielding blades are sharply sloped, the edge of the band hole of the shielding blade may catch on the tooth groove of the toothed rod band which is moving relative thereto, and a case may occur wherein smooth rod movement is prevented. In a state wherein the shielding blade is sloped in any direction, an arrangement is strongly desired wherein the edge of the band hole does not catch on the tooth groove of the toothed rod band, and wherein smooth movements of the moving rod can be made. FIGS. 29 through 31 illustrate an example of the shielding blade. In FIG. 29, the drawing shows a shielding blade 5*n* in the state of sloping downwards toward the back side. The toothed rod band 3*n* moves in the upper direction as to the shielding blade 5*n* as shown with an arrow 100. The spacing denoted by the reference mark L is the spacing between the front edge 101 and back edge 102 of the roughly square band hole, i.e. the dimension of the band hole in the width direction of the blade 5*n*. The shielding blade 5*n* is fully sloped downward toward the back side, and the back edge 102 is in the proximity sufficient to make contact with the back face 103 of the toothed rod band 3*n*. On the other hand, the front edge 101 side has provided thereto a protruding portion 106 made up of an upper protruding portion 104 which protrudes toward the upper face side of the blade and a lower protruding portion 105 which protrudes toward the lower face side of the blade. The protruding portion 106 makes up a side view in a droplet shape extending toward the front side of the blade, with the front edge 101 side having a rounded shape of a half-circle or half-ellipsoid shape, and the height thereof formed to be a height which will not deeply fallen into the tooth groove 107 of the toothed rod band 3*n*. In FIG. 29, the protruding portion 106 is in the state of the upper protruding portion 104 side having lightly fallen into the tooth groove 107. In this state, the toothed rod band 3*n* moves in the upward direction, whereby a tooth tip 108 on the lower side of the tooth groove 107 advances smoothly so as to push out the rounded front edge 101 side of the protruding portion 106 without catching. It can be understood that similarly, in the event that the toothed rod band 3*n* moves in the lower direction, the tooth tip on the upper side of the tooth groove 107 advances so as to push out the protruding portion 106, and flows without catching. Thus, catching the shielding blade on the rod band in the state of sloping downwards toward the back side can be prevented. FIG. 30 shows a state wherein the shielding blade 5*n* is fully sloped downwards toward the front side. The toothed rod band 3*n* is moved in the lower direction as to the shielding blade 5*n* as shown with the arrow 110. Here also the back edge 102 is in the proximity sufficient to make contact with the back face 103 of the toothed rod band 3*n*. In FIG. 30, the protruding portion 106 is in the state of the lower protruding portion 105 side having lightly fallen into the tooth groove 107. In this state, the toothed rod band 3*n* moves in the downward direction, whereby a tooth tip 111 on the upper side of the tooth groove 107 advances smoothly so as to push out the rounded front edge 101 side of the protruding portion 106 without catching. It can be understood that similarly, in the event that the toothed rod band 3*n* moves in the upper direction, the tooth tip on the lower side of the tooth groove 107 advances so as to push out the protruding portion 106, and flows without catching. Thus, catching the shielding blade on the toothed rod band 3*n* in the state of sloping downwards toward the front side can be prevented. In FIG. 31, the spacing denoted by the reference mark W is the width of the toothed rod band 3*n*, and the spacing denoted by the reference mark WH is the spacing between the right edge 112 and the left edge 113 of the band hole 109, that is the width of the band hole in the longitudinal direction of the blade 5*n*. The upper protruding portion 104 and the lower protruding portion 105 are formed so as to alternately protrude in the upper face side and lower face side of the shielding blade, side by side, at an inner side position of the width of the toothed rod band 3*n*. Thus by providing a protruding portion 106 made up of an upper protruding portion 104 which protruding toward the upper face side and a lower protruding portion 105 which protruding toward the lower face side on the front side of the front edge 101, shielding blades without catching regardless of the direction of flow of the toothed rod band can be obtained. The protruding portion 106 shown here can be fabricated on the shielding blade face comparatively easily.

Figure 32:
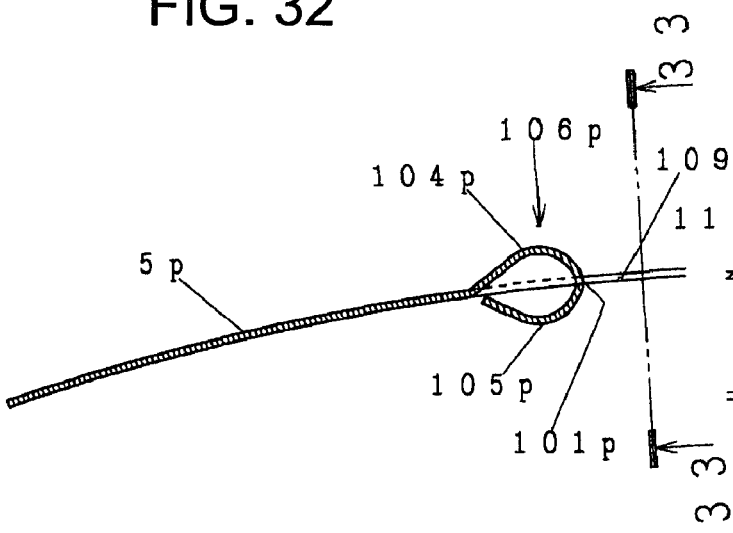
FIG. 32 is a vertical cross-sectional view perpendicular to the blades at hole portions of the horizontal shielding blades in another embodiment.
Figure 33:
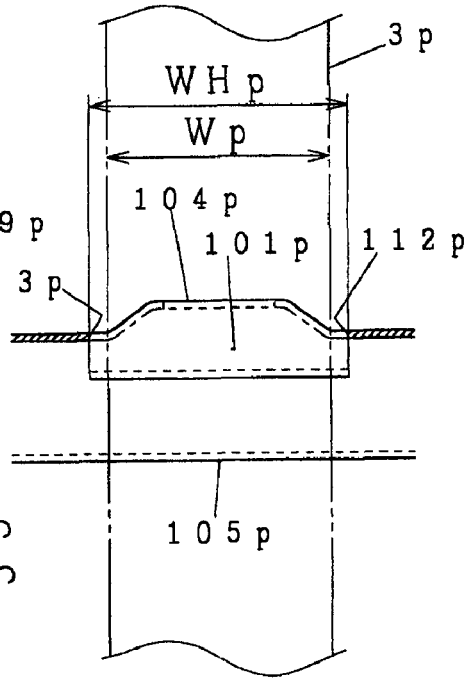
FIG. 33 is a cross-sectional view along 33-33 in FIG. 32.

FIGS. 32 and 33 illustrate another example. The protruding portion 106*p* is made up of an upper protruding portion 104*p* which is formed so as to raise up toward the upper face side of the shielding blade 5*p* in a central position of the front edge of the band hole 109*p*, and a lower protruding portion 105*p* which is deeply bent in diagonally toward the front side of the protruding blade with some rounding toward the lower face side of the shielding blade from the front edge 101*p* side portion of the upper protruding portion 104*p*, thus forming a droplet shaped cross-section shape. This example has the advantage of the front edge 101*p* being continuously formed smoothly from the upper protruding portion 104*p* side to the lower protruding portion 105*p*.

INDUSTRIAL APPLICABILITY

According to the present invention, a blind employing a toothed band body according to the present invention can be used widely in general households, workplaces, and other locations, to provide a more enjoyable living space or work space because of the improved functionality thereof.

The invention claimed is:

1. A horizontal shielding blade blind comprising:

an upper rod;

a moving rod held movably below the upper rod;

a pair of toothed rod bands extending between the upper rod and the moving rod;

a plurality of horizontal shielding blades disposed between the upper rod and the moving rod, the horizontal shielding blades having a pair of holes to allow the toothed rod bands to move therethrough, a rod operating means comprising a gear to engage with a toothed face of the toothed rod bands.

2. The horizontal shielding blade blind according to claim 1 comprising:

a first toothed rod band holding means to hold the toothed rod bands on upper side, the first toothed rod band holding means being disposed in the upper rod; and a second toothed rod band holding means to hold the toothed rod band on lower side, the second toothed rod band holding means being disposed in the moving rod.

3. The horizontal shielding blade blind according to claim 2, wherein the first toothed rod band holding means comprises:

a horizontal shaft rotatably supported by a bearing disposed in the upper rod;

a pair of tube bodies, each supported on the horizontal shaft at a position corresponding to one of the toothed rod bands, the tube bodies being movable along the horizontal shaft, the tube bodies rotating associated with a rotation of the horizontal shaft, wherein an upper end of each of the toothed rod bands is fixed on a corresponding one of the tube bodies, and the toothed rod bands are spirally wound on the tube bodies.

4. The horizontal shielding blade blind according to claim 2, wherein the first toothed rod band holding means comprises:

a horizontal shaft rotatably supported by a bearing disposed in the upper rod;

a pair of gears, each of the gear supported on the horizontal shaft at a position corresponding to one of the toothed rod bands, wherein an upper side of each of the toothed rod bands is held by a corresponding one of the gears.

5. The horizontal shielding blade blind according to claim 2, wherein the first toothed rod band holding means comprises:

a horizontal shaft rotatably supported by a bearing disposed in the upper rod;

a tube body supported on the horizontal shaft, the tube body movable along the horizontal shaft, the tube bodies rotating associated with a rotation of the horizontal shaft, wherein an upper end of each of the toothed rod bands is fixed at a corresponding position on the tube body, and the toothed rod bands are spirally wound on the tube body.

6. The horizontal shielding blade blind according to claim 2, wherein the second toothed rod band holding means comprises:

a horizontal shaft rotatably supported by a bearing disposed in the moving rod;

a tube body supported on the horizontal shaft, the tube body movable along the horizontal shaft, the tube body rotating associated with a rotation of the horizontal shaft, wherein a lower end of each of the toothed rod bands is fixed at a corresponding position on the tube body, and the toothed rod bands are spirally wound on the tube body.

7. The horizontal shielding blade blind according to claim 4, wherein the rod band holding means has a gear, and the rod operating means having, in a space formed below the gear in the upper rod, a stopping piece having:

a first toothed face capable of engaging with the toothed face of one of the toothed rod bands hanging down from the gear facing on the front side thereof, and a second toothed face capable of engaging with the gear facing the toothed face on the upper side thereof, the stopping piece being guided by a stopping piece guide means movable generally vertically in the space.

8. The horizontal shielding blade blind according to claim 2, further comprising:

a intermediate moving rod supported between the upper rod and the moving rod, and movable keeping parallel to the upper rod, the first intermediate moving rod having a pair of openings to have the toothed rod bands pass through, comprising:

an intermediate toothed rod band holding means to hold a pair of toothed rod bands; and an intermediate rod operating means to move and hold the moving rod in a vertical direction, wherein the horizontal shielding blades are disposed between the upper rod and the first intermediate moving rod, and between the second intermediate moving rod and the moving rod.

9. The horizontal shielding blade blind according to claim 8, further comprising:

a second intermediate moving rod supported below the first intermediate moving rod, and movable keeping parallel to the upper rod, the second intermediate moving rod having a pair of pass-through slots to have the toothed rod bands pass through, comprising a second intermediate toothed rod band holding means to hold a pair of toothed rod bands and a second intermediate rod operating means to move and hold the moving rod in a vertical direction, wherein the horizontal shielding blades are disposed between the upper rod and the first intermediate moving rod, and between the second intermediate moving rod and the moving rod, and a view shield adjusting face is formed between the first intermediate moving rod and the second intermediate moving rod.

10. The horizontal shielding blade blind according to claim 8, wherein the intermediate moving rod comprising:

a horizontal shaft rotatably supported by a bearing disposed in the intermediate moving rod; and a pair of traveling gears, each of the gears being supported on the horizontal shaft at a position corresponding to one of the toothed rod bands, wherein each of the toothed rod bands is held by the corresponding one of the gears engaging with the toothed rod bands.

11. The horizontal shielding blade blind according to claim 3, wherein the rod operating means comprises:

a toothed operating band having a width same as the toothed rod band, the toothed operating band has an upper end fixed on the outer circumference of the tube body, the toothed operating band being wound in a opposite direction from a direction of winding of the toothed rod band, the toothed operating band hanging on a front side;

a stopping piece disposed in a space under the tube body in the upper rod, the stopping piece having a toothed face capable of engaging with the toothed face of the toothed operating band hanging down, the stopping piece being movable back and forth, a stopping piece guide means to guide the stopping piece, the stopping piece guide means being disposed in the upper rod; and a back guiding face formed as a flat surface sloping down toward the front at a position where the toothed operating band is hanging down and on a back side portion of the rod.

12. The horizontal shielding blade blind according to claim 7, wherein the first toothed face of the stopping piece projects beyond a front end of the gear when the first toothed face engage with the toothed face of the toothed rod bands.

13. The horizontal shielding blade blind according to claim 3, wherein the rod operating means comprises:

an operating gear attached on the horizontal shaft of the toothed rod band holding means so that the operating gear rotates together with the toothed rod band holding means;

a smooth recessed face on the lower side of the operating gear a toothed operating band engaged with the operating gear and having a pulling side hanging on a front side of the operating gear and a slack side led downward along the recessed face from the rear side of the operating gear;

a stopping piece swingable forward and backward disposed in a space under the operating gear, the stopping piece having a toothed face capable of engaging with the toothed face of the toothed operation band hanging down on the pulling side;

a stopping piece guide means to guide the stopping piece, the stopping piece guide means being disposed in the upper rod; and a back guiding face formed as a flat surface sloping down toward the front at a position where the toothed operation band is hanging down and on a back side portion of the rod.

14. The horizontal shielding blade blind according to claim 7, wherein the stopping piece guide means comprises a support pin swingably supporting the stopping piece in the upper rod.

15. The horizontal shielding blade blind as claimed in claim 7, wherein the stopping piece guide means comprising:

a guide groove formed on both side of the side guiding face on the rod side;

a guide protruding portion formed on both sides of the stopping piece so as to fit slidable into the guide groove.

16. The horizontal shielding blade blind according to claim 13, wherein the stopping piece guide means of the horizontal shaft supports swingably an arm portion extending from the stopping piece with a side portion of the operating gear.

17. The horizontal shielding blade blind as claimed in claim 2, wherein the band hole of the horizontal shielding blades comprising:

a protrusion portion means comprises an upper protruding portion which protrudes toward the upper face side of the shielding blade and a lower protruding portion which protrudes toward the lower face side of the shielding blade, on the edge side facing a tooth face of the toothed rod band which passing through the band hole, wherein the upper protruding portion and the lower protruding portion make a cross section of a droplet shape, and the protrusion portion has a height which prevent the blade from falling into a tooth groove of the toothed rod band.

18. The horizontal shielding blade blind as claimed in claim 17, wherein the upper protruding portion and the lower protruding portion are formed so as to alternately protrude in the upper face side and lower face side of the shielding blade, side by side, on the edge side facing the tooth face of the toothed rod band which passes through the band hole.

19. The horizontal shielding blade blind as claimed in claim 17, wherein the upper protruding portion is formed to protrude toward the upper face side of the shielding blade in a central position of the edge of the band hole; and the lower protruding portion is bent toward the lower face side of the shielding blade from the front edge side portion of the upper protruding portion, thus forming the droplet shaped cross-section on the edge side where facing the tooth face of the toothed rod band which passing through the band hole.

* * * * *